US007938186B1

(12) United States Patent
Badalamenti et al.

(10) Patent No.: US 7,938,186 B1
(45) Date of Patent: May 10, 2011

(54) CASING SHOES AND METHODS OF REVERSE-CIRCULATION CEMENTING OF CASING

(75) Inventors: Anthony M. Badalamenti, Katy, TX (US); Simon Turton, Kingwood, TX (US); Karl W. Blanchard, Cypress, TX (US); Ronald R. Faul, Katy, TX (US); Michael G. Crowder, Orlando, FL (US); Henry E. Rogers, Duncan, OK (US); James E. Griffith, Loco, OK (US); B. Raghava Reddy, Duncan, OK (US)

(73) Assignee: Halliburton Energy Services Inc., Duncan, OK (US)

( * ) Notice: Subject to any disclaimer, the term of this patent is extended or adjusted under 35 U.S.C. 154(b) by 716 days.

(21) Appl. No.: 11/940,095

(22) Filed: Nov. 14, 2007

Related U.S. Application Data

(62) Division of application No. 10/929,163, filed on Aug. 30, 2004, now Pat. No. 7,322,412.

(51) Int. Cl.
*E21B 33/12* (2006.01)

(52) U.S. Cl. ..... 166/285; 166/179

(58) Field of Classification Search ..... 166/135, 166/179, 387, 376, 250.14, 285, 292
See application file for complete search history.

(56) References Cited

U.S. PATENT DOCUMENTS

| | | | | |
|---|---|---|---|---|
| 2,223,509 | A | 12/1940 | Brauer | 166/4 |
| 2,230,589 | A | 2/1941 | Driscoll | 285/22 |
| 2,407,010 | A | 9/1946 | Hudson | 103/5 |
| 2,472,466 | A | 6/1949 | Counts, et al. | 285/22 |
| 2,647,727 | A | 8/1953 | Edwards | 255/28 |
| 2,675,082 | A | 4/1954 | Hall | 166/22 |
| 2,849,213 | A | 8/1958 | Failing | 255/24 |
| 2,919,709 | A | 1/1960 | Schwegman | 137/68 |
| 3,051,246 | A | 8/1962 | Clark, Jr. et al. | 166/226 |
| 3,193,010 | A | 7/1965 | Bielstien | 166/21 |

(Continued)

FOREIGN PATENT DOCUMENTS

EP 0 419 281 A2 3/1991

(Continued)

OTHER PUBLICATIONS

Office Action mailed Jan. 29, 2007 for U.S. Appl. No. 10/929,163.

(Continued)

*Primary Examiner* — Daniel P Stephenson
(74) *Attorney, Agent, or Firm* — John W. Wustenberg; Baker Botts, LLP

(57) ABSTRACT

A method having the following steps: running a circulation valve comprising a reactive material into the well bore on the casing; reverse-circulating an activator material in the well bore until the activator material contacts the reactive material of the circulation valve; reconfiguring the circulation valve by contact of the activator material with the reactive material; and reverse-circulating a cement composition in the well bore until the reconfigured circulation valve decreases flow of the cement composition. A circulation valve for cementing casing in a well bore, the valve having: a valve housing connected to the casing and comprising a reactive material; a plurality of holes in the housing, wherein the plurality of holes allow fluid communication between an inner diameter of the housing and an exterior of the housing, wherein the reactive material is expandable to close the plurality of holes.

23 Claims, 16 Drawing Sheets

U.S. PATENT DOCUMENTS

| | | | | |
|---|---|---|---|---|
| 3,277,962 | A | 10/1966 | Flickinger, et al. | 166/15 |
| 3,570,596 | A | 3/1971 | Young | 166/129 |
| 3,948,322 | A | 4/1976 | Baker | 166/289 |
| 3,948,588 | A | 4/1976 | Curington et al. | 417/405 |
| 3,951,208 | A | 4/1976 | Delano | 166/78 |
| 4,105,069 | A | 8/1978 | Baker | 166/51 |
| 4,271,916 | A | 6/1981 | Williams | 175/215 |
| 4,300,633 | A | 11/1981 | Stewart | 166/250 |
| 4,304,298 | A | 12/1981 | Sutton | 166/293 |
| 4,340,427 | A | 7/1982 | Sutton | 106/87 |
| 4,367,093 | A | 1/1983 | Burkhalter et al. | 106/87 |
| RE31,190 | E | 3/1983 | Detroit et al. | 166/293 |
| 4,450,010 | A | 5/1984 | Burkhalter et al. | 106/87 |
| 4,469,174 | A | 9/1984 | Freeman | 166/202 |
| 4,474,241 | A | 10/1984 | Freeman | |
| 4,519,452 | A | 5/1985 | Tsao et al. | 166/288 |
| 4,531,583 | A | 7/1985 | Revett | 166/253 |
| 4,548,271 | A | 10/1985 | Keller | 166/291 |
| 4,555,269 | A | 11/1985 | Rao et al. | 106/90 |
| 4,565,578 | A | 1/1986 | Sutton et al. | 106/87 |
| 4,671,356 | A | 6/1987 | Barker et al. | 166/285 |
| 4,676,832 | A | 6/1987 | Childs et al. | 106/90 |
| 4,791,988 | A | 12/1988 | Trevillion | 166/285 |
| 4,961,465 | A | 10/1990 | Brandell | 166/184 |
| 5,024,273 | A | 6/1991 | Coone et al. | 166/289 |
| 5,117,910 | A | 6/1992 | Brandell et al. | 166/291 |
| 5,125,455 | A | 6/1992 | Harris et al. | 166/292 |
| 5,133,409 | A | 7/1992 | Bour et al. | 166/293 |
| 5,147,565 | A | 9/1992 | Bour et al. | 252/8.551 |
| 5,188,176 | A | 2/1993 | Carpenter | 166/285 |
| 5,213,161 | A | 5/1993 | King et al. | 166/293 |
| 5,273,112 | A | 12/1993 | Schultz | 166/374 |
| 5,297,634 | A | 3/1994 | Loughlin | 166/387 |
| 5,318,118 | A | 6/1994 | Duell | 166/202 |
| 5,323,858 | A | 6/1994 | Jones et al. | 166/291 |
| 5,361,842 | A | 11/1994 | Hale et al. | 166/293 |
| 5,368,588 | A | 11/1994 | Bettinger | |
| 5,484,019 | A | 1/1996 | Griffith | 166/293 |
| 5,494,107 | A | 2/1996 | Bode | 166/285 |
| 5,507,345 | A | 4/1996 | Wehunt, Jr. et al. | 166/285 |
| 5,559,086 | A | 9/1996 | Dewprashad et al. | 507/219 |
| 5,571,281 | A | 11/1996 | Allen | 366/2 |
| 5,577,865 | A | 11/1996 | Manrique et al. | 405/266 |
| 5,641,021 | A | 6/1997 | Murray et al. | 166/291 |
| 5,647,434 | A | 7/1997 | Sullaway et al. | 166/242.8 |
| 5,671,809 | A | 9/1997 | McKinzie | 166/285 |
| 5,718,292 | A | 2/1998 | Heathman et al. | 166/387 |
| 5,738,171 | A | 4/1998 | Szarka | 166/289 |
| 5,749,418 | A | 5/1998 | Mehta et al. | 166/292 |
| 5,762,139 | A | 6/1998 | Sullaway et al. | 166/291 |
| 5,803,168 | A | 9/1998 | Lormand et al. | 166/77.2 |
| 5,829,526 | A | 11/1998 | Rogers et al. | 166/291 |
| 5,875,844 | A | 3/1999 | Chatterji et al. | 166/293 |
| 5,890,538 | A | 4/1999 | Beirute et al. | |
| 5,897,699 | A | 4/1999 | Chatterji et al. | 106/678 |
| 5,900,053 | A | 5/1999 | Brothers et al. | 106/678 |
| 5,913,364 | A | 6/1999 | Sweatman | 166/281 |
| 5,968,255 | A | 10/1999 | Mehta et al. | 106/724 |
| 5,972,103 | A | 10/1999 | Mehta et al. | 106/728 |
| 6,060,434 | A | 5/2000 | Sweatman et al. | 507/216 |
| 6,063,738 | A | 5/2000 | Chatterji et al. | 507/269 |
| 6,098,710 | A | 8/2000 | Rhein-Knudsen et al. | 166/285 |
| 6,138,759 | A | 10/2000 | Chatterji et al. | 166/293 |
| 6,143,069 | A | 11/2000 | Brothers et al. | 106/678 |
| 6,167,967 | B1 | 1/2001 | Sweatman | 166/281 |
| 6,196,311 | B1 | 3/2001 | Treece | 166/192 |
| 6,204,214 | B1 | 3/2001 | Singh et al. | 501/155 |
| 6,244,324 | B1 | 6/2001 | Quates et al. | 166/285 |
| 6,244,342 | B1 | 6/2001 | Sullaway et al. | |
| 6,258,757 | B1 | 7/2001 | Sweatman et al. | 507/219 |
| 6,311,775 | B1 | 11/2001 | Allamon et al. | 166/285 |
| 6,318,472 | B1 | 11/2001 | Rogers et al. | 166/382 |
| 6,367,550 | B1 | 4/2002 | Chatterji et al. | 166/293 |
| 6,422,575 | B1 | 7/2002 | Czaplicki et al. | |
| 6,431,282 | B1 | 8/2002 | Bosma et al. | 166/288 |
| 6,454,001 | B1 | 9/2002 | Thompson et al. | 166/250.14 |
| 6,457,524 | B1 | 10/2002 | Roddy | 166/293 |
| 6,467,546 | B2 | 10/2002 | Allamon et al. | 166/381 |
| 6,481,494 | B1 | 11/2002 | Dusterhoft et al. | 166/51 |
| 6,484,804 | B2 | 11/2002 | Allamon et al. | 166/291 |
| 6,488,088 | B1 | 12/2002 | Kohli et al. | 166/285 |
| 6,488,089 | B1 | 12/2002 | Bour et al. | 166/292 |
| 6,488,763 | B2 | 12/2002 | Brothers et al. | 106/692 |
| 6,540,022 | B2 | 4/2003 | Dusterhoft et al. | 166/278 |
| 6,622,794 | B2 | 9/2003 | Zisk, Jr. | |
| 6,622,798 | B1 | 9/2003 | Rogers et al. | 166/380 |
| 6,666,266 | B2 | 12/2003 | Starr et al. | 166/90.1 |
| 6,679,336 | B2 | 1/2004 | Musselwhite et al. | 166/386 |
| 6,715,553 | B2 | 4/2004 | Reddy et al. | 166/309 |
| 6,722,434 | B2 | 4/2004 | Reddy et al. | 166/292 |
| 6,725,935 | B2 | 4/2004 | Szarka et al. | 166/318 |
| 6,732,797 | B1 | 5/2004 | Watters et al. | 166/291 |
| 6,758,281 | B2 | 7/2004 | Sullaway et al. | 166/386 |
| 6,802,374 | B2 | 10/2004 | Edgar et al. | 166/285 |
| 6,808,024 | B2 | 10/2004 | Schwendemann et al. | 166/387 |
| 6,810,958 | B2 | 11/2004 | Szarka et al. | 166/285 |
| 6,935,432 | B2 * | 8/2005 | Nguyen | 166/387 |
| 7,032,675 | B2 | 4/2006 | Steele et al. | |
| 7,228,915 | B2 * | 6/2007 | Thomson | 166/387 |
| 2002/0148615 | A1 | 10/2002 | Szarka et al. | |
| 2003/0000704 | A1 | 1/2003 | Reynolds | 166/312 |
| 2003/0029611 | A1 | 2/2003 | Owens | 166/250.03 |
| 2003/0072208 | A1 | 4/2003 | Rondeau et al. | 366/16 |
| 2003/0192695 | A1 | 10/2003 | Dillenbeck et al. | |
| 2004/0055758 | A1 | 3/2004 | Brezinski et al. | |
| 2004/0055760 | A1 | 3/2004 | Nguyen | |
| 2004/0079553 | A1 | 4/2004 | Livingstone | 175/61 |
| 2004/0084182 | A1 | 5/2004 | Edgar et al. | 166/285 |
| 2004/0099413 | A1 | 5/2004 | Arceneaux | 166/173 |
| 2004/0104050 | A1 | 6/2004 | Järvelå et al. | 175/57 |
| 2004/0104052 | A1 | 6/2004 | Livingstone | 175/61 |
| 2004/0177962 | A1 | 9/2004 | Bour | 166/285 |
| 2004/0231846 | A1 | 11/2004 | Griffith et al. | 166/291 |
| 2005/0061546 | A1 | 3/2005 | Hannegan | 175/7 |
| 2005/0072578 | A1 | 4/2005 | Steele et al. | |
| 2006/0016599 | A1 | 1/2006 | Badalamenti et al. | 166/285 |
| 2006/0016600 | A1 | 1/2006 | Badalamenti et al. | 166/285 |
| 2006/0042798 | A1 | 3/2006 | Badalamenti et al. | 166/285 |
| 2006/0076135 | A1 | 4/2006 | Rogers et al. | |
| 2006/0086499 | A1 | 4/2006 | Badalamenti et al. | 166/250.14 |
| 2006/0086502 | A1 | 4/2006 | Reddy et al. | 166/291 |
| 2006/0086503 | A1 | 4/2006 | Reddy et al. | 166/293 |
| 2006/0131018 | A1 | 6/2006 | Rogers et al. | 166/285 |

FOREIGN PATENT DOCUMENTS

| | | | |
|---|---|---|---|
| EP | 1 739 278 | A2 | 1/2007 |
| EP | 1 739 278 | A3 | 8/2007 |
| GB | 2193741 | | 2/1988 |
| GB | 2327442 | A | 11/1999 |
| GB | 2348828 | A | 10/2000 |
| RU | 1774986 | | 11/1992 |
| RU | 1778274 | | 11/1992 |
| RU | 1542143 | C | 12/1994 |
| RU | 2067158 | | 9/1996 |
| RU | 2 086 752 | C1 | 8/1997 |
| SU | 571584 | | 9/1977 |
| SU | 1420139 | A1 | 8/1988 |
| SU | 1534183 | | 1/1990 |
| SU | 1716096 | A1 | 2/1992 |
| SU | 1723309 | A1 | 3/1992 |
| SU | 1758211 | A1 | 8/1992 |
| WO | WO 02/48503 | A1 | 6/2001 |
| WO | WO 03/008756 | | 1/2003 |
| WO | WO 2004/104366 | | 12/2004 |
| WO | WO 2005/083299 | A | 9/2005 |
| WO | WO 2006/008490 | A1 | 1/2006 |
| WO | WO 2006/064184 | A1 | 6/2006 |

OTHER PUBLICATIONS

Office Action mailed Jun. 8, 2007 for U.S. Appl. No. 10/929,163.

Search Report for European Patent Application No. 10178015.3 dated Oct. 27, 2010.

Notification of European Publication No. for EP 10178015.3 dated Nov. 4, 2010.

Extended Search Report for EP 10178042.7 dated Oct. 27, 2010.

Notification of European Publication No. for EP 10178042.7 dated Nov. 4, 2010.
Notification Regarding Publication of European Search Report for EP 10178042.7 dated Dec. 6, 2010.
Notification of European Publication No. for EP 10178032.8 dated Nov. 4, 2010.
Notification Regarding Publication of European Search Report for EP 10178032.8 dated Dec. 6, 2010.
Extended Search Report for EP 10178032.8 dated Oct. 25, 2010.
Office Action for U.S. Appl. No. 11/940,077, dated Dec. 15, 2008.
Notice of Publication dated Mar. 13, 2008 from U.S. Appl. No. 11/939,962.
Notice of Publication dated Mar. 13, 2008 from U.S. Appl. No. 11/940,077.
Notice of Publication dated Apr. 17, 2008 from U.S. Appl. No. 11/940,040.
Notice of Publication dated Mar. 13, 2008 from U.S. Appl. No. 11/940,001.
Office Action dated Mar. 21, 2008 from U.S. Appl. No. 11/940,077.
Office Action dated Mar. 25, 2008 from U.S. Appl. No. 11/939,962.
Office Action dated Mar. 21, 2008 from U.S. Appl. No. 11/940,001.
Office Action mailed Jun. 26, 2008 for U.S. Appl. No. 11/940,040.
Office Action for U.S. Appl. No. 11/940,001, dated Aug. 5, 2009.
Office Action for U.S. Appl. No. 11/940,077, dated Aug. 5, 2009.
Office Action mailed Sep. 2, 2008 for U.S. Appl. No. 11/939,962.
Office Action mailed Sep. 2, 2008 for U.S. Appl. No. 11/940,001.
Office Action mailed Sep. 2, 2008 for U.S. Appl. No. 11/940,077.
Notice of Allowance and Notice of Allowability for U.S. Appl. No. 11/940,077, dated Oct. 6, 2009.
Notice of Allowance and Notice of Allowability for U.S. Appl. No. 11/940,001, dated Oct. 6, 2009.
Griffith, et al., "Reverse Circulation of Cement on Primary Jobs Increases Cement Column Height Across Weak Formations," Society of Petroleum Engineers, SPE 25440, 315-319, Mar. 22-23, 1993.
Filippov, et al., "Expandable Tubular Solutions," Society of Petroleum Engineers, SPE 56500, Oct. 3-6, 1999.
Daigle, et al., "Expandable Tubulars: Field Examples of Application in Well Construction and Remediation," Society of Petroleum Engineers, SPE 62958, Oct. 1-4, 2000.
Fryer, "Evaluation of the Effects of Multiples in Seismic Data From the Gulf Using Vertical Seismic Profiles," SPE 25540, 1993.
Carpenter, et al., "Remediating Sustained Casing Pressure by Forming a Downhole Annular Seal With Low-Melt-Point Eutectic Metal," IADC/SPE 87198, Mar. 2-4, 2004.
Halliburton Casing Sales Manual, Section 4, Cementing Plugs, p. 4-29 and 4-30, Oct. 6, 1993.
G.L. Cales, "The Development and Applications of Solid Expandable Tubular Technology," Paper No. 2003-136, Petroleum Society's Canadian International Petroleum Conference 2003, Jun. 10-12, 2003.
Gonzales, et al., "Increasing Effective Fracture Gradients by Managing Wellbore Temperatures," IADC/SPE 87217, Mar. 2-4, 2004.
Griffith, "Monitoring Circulatable Hole With Real-Time Correction: Case Histories," SPE 29470, 1995.
Ravi, "Drill-Cutting Removal in a Horizontal Wellbore for Cementing," IADC/SPE 35081, 1996.
MacEachern, et al. , "Advances in Tieback Cementing," IADC/SPE 79907, 2003.
Davies, et al, "Reverse Circulation of Primary Cementing Jobs—Evaluation and Case History," IADC/SPE 87197, Mar. 2-4, 2004.
Abstract No. XP-002283587, "Casing String Reverse Cemented Unit Enhance Efficiency Hollow Pusher Housing", Aug. 30, 1992.
Abstract No. XP-002283586, "Reverse Cemented Casing String Reduce Effect Intermediate Layer Mix Cement Slurry Drill Mud Quality Lower Section Cement Lining", Aug. 30, 1988.
Brochure, Enventure Global Technology, "Expandable-Tubular Technology," pp. 1-6, 1999.
Dupal, et al, "Solid Expandable Tubular Technology—A Year of Case Histories in the Drilling Environment," SPE/IADC 67770, Feb. 27-Mar. 1, 2001.
DeMong, et al., "Planning the Well Construction Process for the Use of Solid Expandable Casing," SPE/IADC 85303, Oct. 20-22, 2003.
Waddell, et al., "Installation of Solid Expandable Tubular Systems Through Milled Casing Windows," IADC/SPE 87208, Mar. 2-4, 2004.
DeMong, et al., "Breakthroughs Using Solid Expandable Tubulars to Construct Extended Reach Wells," IADC/SPE 87209, Mar. 2-4, 2004.
Escobar, et al., "Increasing Solid Expandable Tubular Technology Reliability in a Myriad of Downhole Environments," SPE 81094, Apr. 27-30, 2003.
Foreign Communication From a Related Counter Part Application, Oct. 12, 2005.
Foreign Communication From a Related Counter Part Application, Sep. 30, 2005.
Foreign Communication From a Related Counter Part Application, Dec. 7, 2005.
Halliburton Brochure Entitled "Bentonite (Halliburton Gel) Viscosifier", 1999.
Halliburton Brochure Entitled "Cal-Seal 60 Cement Accelerator", 1999.
Halliburton Brochure Entitled "Diacel D Lightweight Cement Additive", 1999.
Halliburton Brochure Entitled "Cementing Flex-Plug® OBM Lost-Circulation Material", 2004.
Halliburton Brochure Entitled "Cementing FlexPlug® W Lost-Circulation Material", 2004.
Halliburton Brochure Entitled "Gilsonite Lost-Circulation Additive", 1999.
Halliburton Brochure Entitled "Micro Fly Ash Cement Component", 1999.
Halliburton Brochure Entitled "Silicalite Cement Additive", 1999.
Halliburton Brochure Entitled "Spherelite Cement Additive", 1999.
Halliburton Brochure Entitled "Increased Integrity With the StrataLock Stabilization System", 1998.
R. Marquaire et al., "Primary Cementing by Reverse Circulation Solves Critical Problem in the North Hassi-Messaoud Field, Algeria", SPE 1111, Feb. 1966.
Halliburton Brochure Entitled "Perlite Cement Additive", 1999.
Halliburton Brochure Entitled "The PermSeal System Versatile, Cost-Effective Sealants for Conformance Applications", 2002.
Halliburton Brochure Entitled "Pozmix® a Cement Additive", 1999.
Foreign Communication From a Related Counter Part Application, Dec. 9, 2005.
Foreign Communication From a Related Counter Part Application, Feb. 24, 2005.
Foreign Communication From a Related Counter Part Application, Dec. 9, 2005.
Foreign Communication From a Related Counter Part Application, Dec. 27, 2005.
Foreign Communication From a Related Counter Part Application, Feb. 23, 2006.
Foreign Communication From a Related Counter Part Application, Feb. 27, 2007.
Foreign Communication From a Related Counter Part Application, Jan. 8, 2007.
Foreign Communication From a Related Counter Part Application, Jan. 17, 2007.
Moore, et al., High-Temperature Wells With Lost-Circulation Demands and Reverse-Circulation Techniques Using Foamed-Cement Systems: Two Case Histories, SPE Drilling & Completion, Jun. 2005.
Office Action for U.S. Appl. No. 11/939,962 dated Dec. 11, 2008.
Office Action for U.S. Appl. No. 11/940,001 dated Dec. 12, 2008.

* cited by examiner

CASING SHOES AND METHODS OF REVERSE-CIRCULATION CEMENTING OF CASING

CROSS-REFERENCE TO RELATED APPLICATIONS

This application is a divisional patent application of commonly-owned U.S. patent application Ser. No. 10/929,163, filed Aug. 30, 2004 now U.S. Pat. No. 7,322,412, entitled "Casing Shoes and Methods of Reverse-Circulation Cementing of Casing," by Badalamenti et al., which is incorporated by reference herein for all purposes.

BACKGROUND OF THE INVENTION

This invention relates to cementing casing in subterranean formations. In particular, this invention relates to methods for cementing a casing annulus by reverse-circulating the cement composition into the annulus without excessive cement composition entering the casing inner diameter.

It is common in the oil and gas industry to cement casing in well bores. Generally, a well bore is drilled and a casing string is inserted into the well bore. Drilling mud and/or a circulation fluid is circulated through the well bore by casing annulus and the casing inner diameter to flush excess debris from the well. As used herein, the term "circulation fluid" includes all well bore fluids typically found in a well bore prior to cementing a casing in the well bore. Cement composition is then pumped into the annulus between the casing and the well bore.

Two pumping methods have been used to place the cement composition in the annulus. In the first method, the cement composition slurry is pumped down the casing inner diameter, out through a casing shoe and/or circulation valve at the bottom of the casing and up through to annulus to its desired location. This is called a conventional-circulation direction. In the second method, the cement composition slurry is pumped directly down the annulus so as to displace well fluids present in the annulus by pushing them through the casing shoe and up into the casing inner diameter. This is called a reverse-circulation direction.

In reverse-circulation direction applications, it is sometimes not desirable for the cement composition to enter the inner diameter of the casing from the annulus through the casing shoe and/or circulation valve. This may be because, if an undesirable amount of a cement composition enters the inner diameter of the casing, once set it typically has to be drilled out before further operations are conducted in the well bore. Therefore, the drill out procedure may be avoided by preventing the cement composition from entering the inner diameter of the casing through the casing shoe and/or circulation valve.

SUMMARY OF THE INVENTION

This invention relates to cementing casing in subterranean formations. In particular, this invention relates to methods for cementing a casing annulus by reverse-circulating the cement composition into the annulus without undesirable amount of a cement composition entering the casing inner diameter.

The invention provides a method of cementing casing in a well bore, the method having the following steps: running a circulation valve comprising a reactive material into the well bore on the casing; reverse-circulating an activator material in the well bore until the activator material contacts the reactive material of the circulation valve; reconfiguring the circulation valve by contact of the activator material with the reactive material; and reverse-circulating a cement composition in the well bore until the reconfigured circulation valve decreases flow of the cement composition.

According to an aspect of the invention, there is provided a method of cementing casing in a well bore, wherein the method has steps as follows: running an annulus packer comprising a reactive material into the well bore on the casing; reverse-circulating an activator material in the well bore until the activator material contacts the reactive material of the packer; reconfiguring the packer by contact of the activator material with the reactive material; and reverse-circulating a cement composition in the well bore until the reconfigured packer decreases flow of the cement composition.

Another aspect of the invention provides a method of cementing casing in a well bore, the method having: running a circulation valve comprising a reactive material and a protective material into the well bore on the casing; reverse-circulating an activator material in the well bore until the activator material contacts the protective material of the circulation valve, wherein the activator material erodes the protective material to expose the reactive material; reconfiguring the circulation valve by exposing the reactive material to a well bore fluid; and reverse-circulating a cement composition in the well bore until the reconfigured circulation valve decreases flow of the cement composition.

According to still another aspect of the invention, there is provided a method of cementing casing in a well bore, the method having the following steps: running an annulus packer comprising a reactive material and a protective material into the well bore on the casing; reverse-circulating an activator material in the well bore until the activator material contacts the protective material of the packer, wherein the activator material erodes the protective material to expose the reactive material; reconfiguring the packer by contact of the reactive material with a well bore fluid; and reverse-circulating a cement composition in the well bore until the reconfigured packer decreases flow of the cement composition.

Still another aspect of the invention provides a circulation valve for cementing casing in a well bore, the valve having: a valve housing connected to the casing and comprising a reactive material; a plurality of holes in the housing, wherein the plurality of holes allow fluid communication between an inner diameter of the housing and an exterior of the housing, wherein the reactive material is expandable to close the plurality of holes.

According to a still further aspect of the invention, there is provided a circulation valve for cementing casing in a well bore, the valve having: a valve housing connected to the casing; at least one hole in the valve housing, wherein the at least one hole allows fluid communication between an inner diameter of the valve housing and an exterior of the valve housing; a plug positioned within the valve housing, wherein the plug is expandable to decrease fluid flow through the inner diameter of the valve housing.

A further aspect of the invention provides a circulation valve for cementing casing in a well bore, the valve having: a valve housing connected to the casing; at least one hole in the valve housing, wherein the at least one hole allows fluid communication between an inner diameter of the valve housing and an exterior of the valve housing; a flapper positioned within the valve housing, wherein the flapper is biased to a closed position on a ring seat within the valve housing; and a lock that locks the flapper in an open configuration allowing fluid to pass through the ring seat, wherein the lock comprises a reactive material.

Another aspect of the invention provides a circulation valve for cementing casing in a well bore, the valve having: a valve housing connected to the casing; at least one hole in the valve housing, wherein the at least one hole allows fluid communication between an inner diameter of the valve housing and an exterior of the valve housing; a sliding sleeve positioned within the valve housing, wherein the sliding sleeve is slideable to a closed position over the at least one hole in the valve housing; and a lock that locks the sliding sleeve in an open configuration allowing fluid to pass through the at least one hole in the valve housing, wherein the lock comprises a reactive material.

According to still another aspect of the invention, there is provided a circulation valve for cementing casing in a well bore, the valve having: a valve housing connected to the casing; at least one hole in the valve housing, wherein the at least one hole allows fluid communication between an inner diameter of the valve housing and an exterior of the valve housing; a float plug positioned within the valve housing, wherein the float plug is moveable to a closed position on a ring seat within the valve housing; and a lock that locks the float plug in an open configuration allowing fluid to pass through the ring seat in the valve housing, wherein the lock comprises a reactive material.

Another aspect of the invention provides a packer for cementing casing in a well bore wherein an annulus is defined between the casing and the well bore, the system having the following parts: a packer element connected to the casing, wherein the packer element allows fluid to pass through the a well bore annulus past the packer element when it is in a non-expanded configuration, and wherein the packer element restricts fluid passage in the annulus past the packer element when the packer element is expanded; an expansion device in communication with the packer element; and a lock that prevents the expansion device from expanding the packer element, wherein the lock comprises a reactive material.

According to another aspect of the invention, there is provided a method of cementing casing in a well bore, the method comprising: running a circulation valve into the well bore on the casing; reverse-circulating a particulate material in the well bore until the particulate material contacts the circulation valve; accumulating the particulate material around the circulation valve, whereby the particulate material forms a cake that restricts fluid flow; and reverse-circulating a cement composition in the well bore until the accumulated particulate material decreases flow of the cement composition.

The objects, features, and advantages of the present invention will be readily apparent to those skilled in the art upon a reading of the description of the preferred embodiments which follows.

BRIEF DESCRIPTION OF THE FIGURES

The present invention may be better understood by reading the following description of non-limitative embodiments with reference to the attached drawings wherein like parts of each of the several figures are identified by the same referenced characters, and which are briefly described as follows.

In FIGS. 6 and 7, the circulation valve remains open.

It is to be noted, however, that the appended drawings illustrate only typical embodiments of this invention and are therefore not to be considered limiting of its scope, as the invention may admit to other equally effective embodiments.

DETAILED DESCRIPTION OF THE INVENTION

Figure 1:
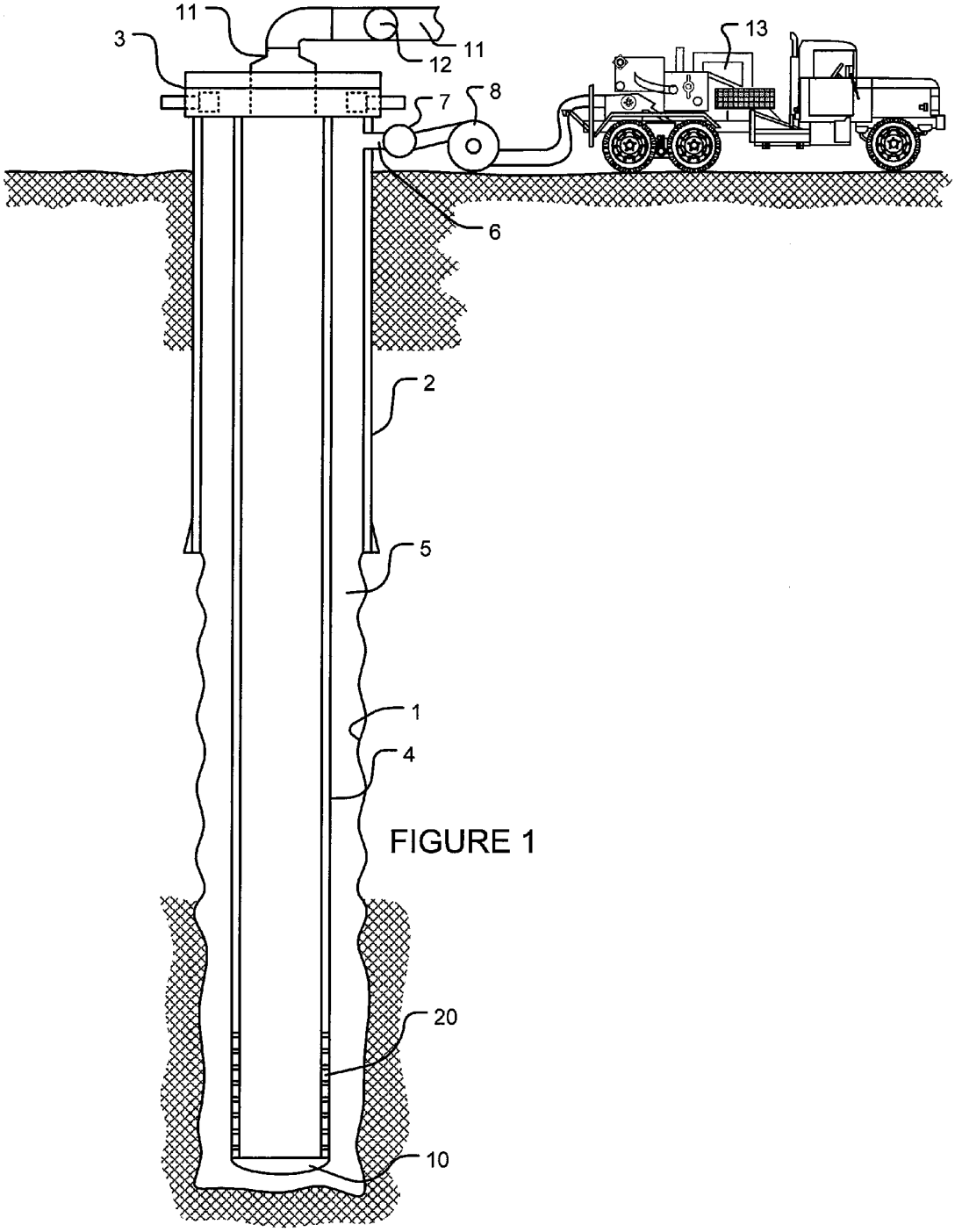
FIG. 1 is a cross-sectional side view of a well bore with casing having a casing shoe and a circulation valve wherein the casing is suspended from a wellhead supported on surface casing.

Referring to FIG. 1, a cross-sectional side view of a well bore is illustrated. In particular, surface casing 2 is installed in the well bore 1. A well head 3 is attached to the top of the surface casing 2 and casing 4 is suspended from the well head 2 and the well bore 1. An annulus 5 is defined between the well bore 1 and the casing 4. A casing shoe 10 is attached to the bottom most portion of the casing 4. A feed line 6 is connected to the surface casing 2 to fluidly communicate with the annulus 5. The feed line 6 has a feed valve 7 and a feed pump 8. The feed line 6 may be connected to a cement pump truck 13. The feed line 6 may also be connected to vacuum truck, a stand alone pump or any other pumping mechanism known to persons of skill. A return line 11 is connected to the well head 3 so as to fluidly communicate with the inner diameter of the casing 4. The return line has a return valve 12. The casing 4 also comprises a circulation valve 20 near the casing shoe 10. When the circulation valve 20 is open, circulation fluid may flow between the annulus 5 and the inner diameter of the casing 4 through the valve.

Figure 2:
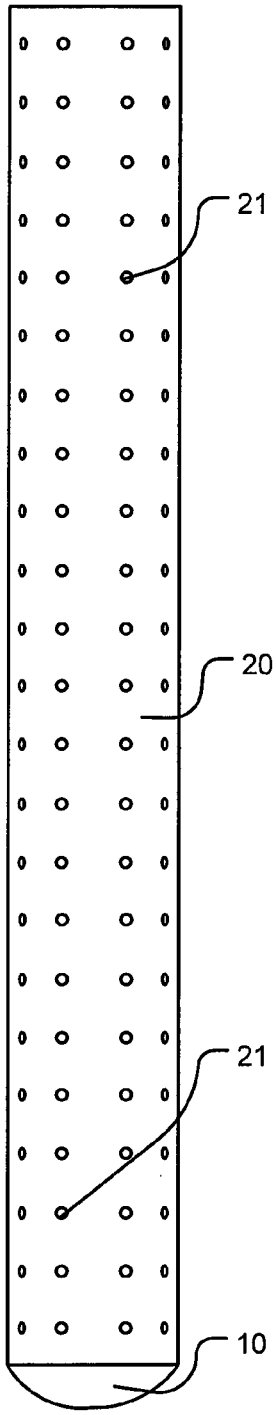
FIG. 2 is a side view of a circulation valve constructed of a cylindrical section with holes, wherein the cylindrical section is coated with or contains an expandable material.

Referring to FIG. 2, a side view of a circulation valve 20 of the present invention is illustrated. In this particular embodiment, the circulation valve 20 is a length of pipe having a plurality of holes 21 formed in the walls of the pipe. A casing shoe 10 is attached to the bottom of the pipe to close the lower end of the pipe. The size and number of the holes 21 are such that they allow a sufficient amount of fluid to pass between the annulus 5 and the inside diameter of the casing 4 through the holes 21. In one embodiment, the cumulative cross-sectional area of the holes 21 is greater than the cross-sectional area of the inside diameter of the casing 4. In this embodiment, the pipe material of the circulation valve 20 is an expandable material. In alternative embodiments, the circulation valve is made of a base material, such as a steel pipe, and a cladding or coating of expandable material. When the expandable material comes into contact with a certain activator material, the expandable material expands to reduce the size of the holes 21. This process is explained more fully below.

In the embodiment illustrated in FIG. 2, circulation valve 20 is a cylindrical pipe section. However, the circulation valve 20 may take any form or configuration that allows the closure of the holes 21 upon expansion of the expandable material. HYDROPLUG, CATGEL, DIAMONDSEAL and the like may be used as the expandable material. These reactive materials may be coated, cladded, painted, glued or otherwise adhered to the base material of the circulation valve 20. Where DIAMONDSEAL, HYDROPLUG, and CATGEL are used as the reactive material for the circulation valve 20, the circulation valve 20 should be maintained in a salt solution prior to activation. An activator material for DIAMONDSEAL, HYDROPLUG, and CATGEL is fresh water, which causes these reactive materials to expand upon contact with the fresh water activator material. Therefore, a salt solution circulation fluid is circulated into the well bore before the circulation valve and casing are run into the well bore. A buffer of the freshwater activator material is then pumped into the annulus at the leading edge of the cement composition in a reverse-circulation direction so that the reactive material (DIAMONDSEAL, HYDROPLUG, or CATGEL) of the circulation valve 20 will be contacted and closed by the fresh water activator material before the cement composition passes through the circulation valve 20. In alternative embodiments, the expandable material may be any expandable material known to persons of skill in the art.

Figure 3A:
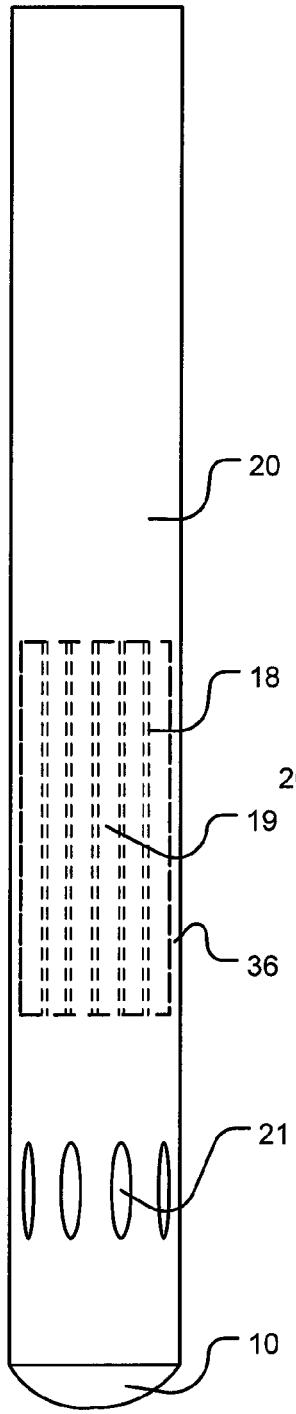
FIG. 3A is a side view of a circulation valve having an expandable material plug in the inner diameter of the circulation valve.
Figure 3B:
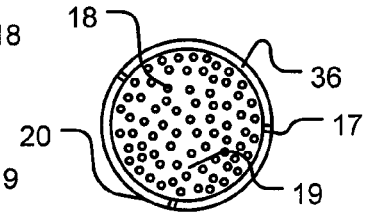
FIG. 3B is a top view of the plug comprising an expandable material located within the circulation valve of FIG. 3A.

FIG. 3A is a side view of an alternative circulation valve 20. The circulation valve 20 has an expandable plug 19. FIG. 3B illustrates a top view of the expandable plug 19 identified in FIG. 3A. The circulation valve 20 has a cylindrical housing made of a pipe section with holes 21. Fluid passes between an annulus 5 on the outside of the circulation valve 20 and the inner diameter of the valve through the holes 21. A casing shoe 10 is attached to the bottom of the circulation valve 20. An expandable plug 19 is positioned within the inner diameter of the circulation valve 20. A plurality of conduits 18 extend through the plug 19 to allow circulation fluid to flow through the plug 19 when the conduits 18 are open. Also, the outside diameter of the expandable plug 19 may be smaller than the inner diameter of the circulation valve 20 so that a gap 36 is defined between. The expandable plug 19 may be suspended in the circulation valve 20 by supports 17 (see FIG. 3B). The expandable plug 19 may be constructed of a structurally rigid base material, like steel, which has an expandable material coated, cladded, painted, glued or otherwise adhered to the exterior surfaces of the plug 19 and the interior surfaces of the conduits 18 in the plug 19. HYDROPLUG, CATGEL, DIAMONDSEAL and the like may be used for the expandable material of the plug 19. The plug may be constructed of a porous base material that is coated, cladded, and/or saturated with one above noted reactive materials, which provides irregular conduits through the open cell structure of the porous base material. The base material may be a polymer mesh or open cell foam or any other open cell structure known to persons of skill. In alternative embodiments, any expandable material known to persons of skill in the art may be used in the expandable plug.

When the expandable plug 19 is not expanded, as illustrated, fluid may also flow through the gap 36 (see FIGS. 3A and 3B). The circulation valve 20 becomes closed when an activator material contacts the expandable plug 19. The expandable plug 19 then expands to constrict the conduits 18 and also to narrow the gap 36. When the expandable plug 19 is fully expanded, the conduits 18 and gap 36 are completely closed to prevent fluid from flowing through the inner diameter of the circulation valve 20.

Figure 4:
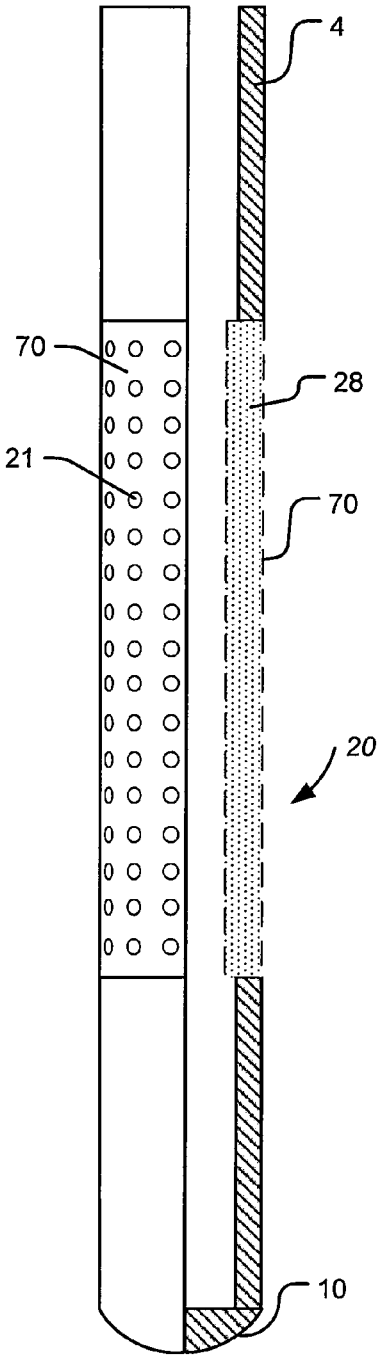
FIG. 4 is a side view of a circulation valve constructed of a cylindrical section having a basket with holes, wherein the basket contains expandable material.

Referring to FIG. 4, an alternative circulation valve 20 of the invention is illustrated, wherein the left side of the figure shows an exterior side view and the right side shows a cross-sectional side view. The circulation valve 20 has a basket 70 that contains a reactive material 28 that is an expandable material. The basket 70 is positioned to replace a portion of the side wall of the casing 4. The basket 70 has holes 21 in both its outer cylindrical wall and its inner cylindrical wall. The reactive material 28 is a granular or particulate material that allows fluid to circulate around and between the particles prior to activation. After the particles are activated, they expand to more fully engage each other and fill the spaces between the particles. Any expandable material described herein or known to persons of skill in the art may be used.

Figure 5A:
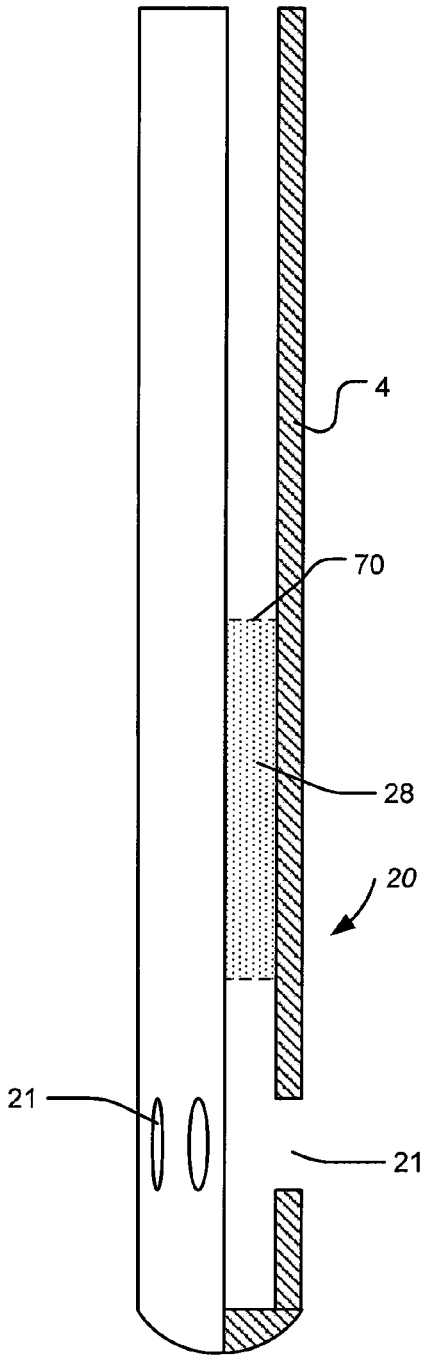
FIG. 5A is a side view of a circulation valve having a basket of expandable material in the inner diameter of the circulation valve.
Figure 5B:
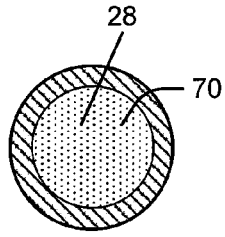
FIG. 5B is a top view of the basket comprising an expandable material located within the circulation valve of FIG. 5A.

FIG. 5A shows a side view of an alternative circulation valve, wherein the left side of the figure shows an exterior side view and the right side shows a cross-sectional side view. FIG. 5B illustrates a cross-section, top view of the circulation valve of FIG. 5A. This circulation valve 20 also comprises a basket 70, but this basket 70 is positioned in the inner diameter of the casing 4. Holes 21 in the casing are positioned below the basket 70 to allow fluid to pass between the inner diameter of the casing 4 and the annulus 5. The basket 70 has a permeable or porous upper and lower surface to allow fluid to pass through the basket 70. The reactive material 28 is contained within the basket 70 and is a granular or particulate material that allows fluid to circulate around and between the particles prior to activation. After the particles are activated, they expand to more fully engage each other and fill the spaces between the particles. Any expandable material described herein or known to persons of skill in the art may be used.

Figure 6:
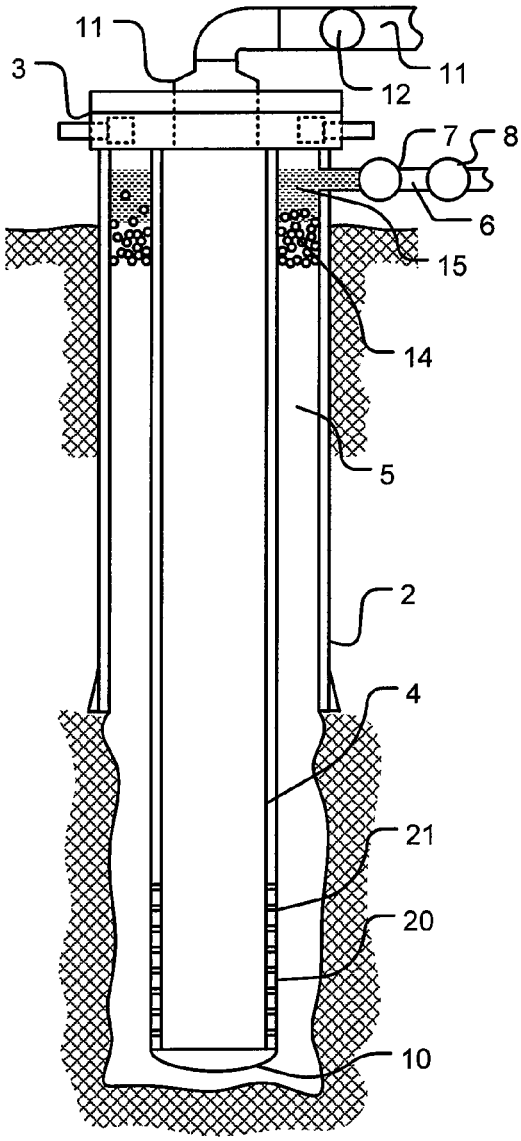
FIG. 6 is a cross-sectional, side view of a well bore having a circulation valve attached to casing suspended in the well bore, wherein an activator material and cement composition is injected into the annulus at the wellhead.

Referring to FIG. 6, a cross-sectional side view of a well bore 1 is illustrated. This well bore configuration is similar to that described relative to FIG. 1. An activator material 14 is injected into the annulus 5 as the fluid in the well bore 1 is reverse-circulated from the annulus 5 through the circulation valve 20 and up through the inside diameter of the casing 4. Cement composition 15 is injected into the annulus 5 behind the activator material 14. The activator material 14 and cement composition 15 descend in the annulus 5 as the various fluids reverse-circulate through the well bore 1.

Figure 7:
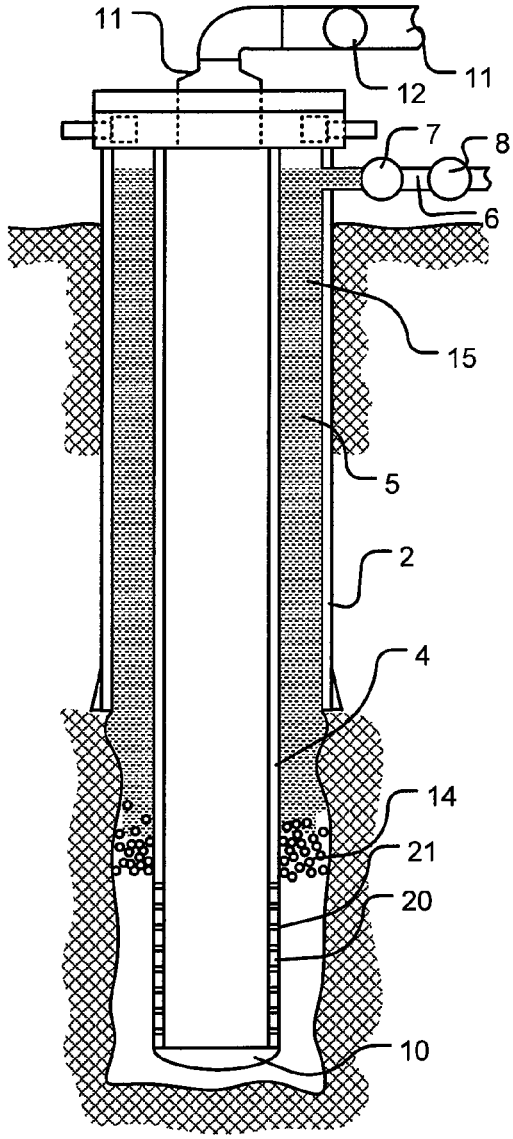
FIG. 7 is a cross-sectional, side view of the well bore shown in FIG. 6, wherein the activator material and cement composition has flowed in the annulus down to the circulation valve.

FIG. 7 is a cross-sectional side view of the well bore shown in FIG. 6. In this illustration, the activator material 14 and cement composition 15 have descended in the annulus to the point where the activator material 14 first comes into contact with the circulation valve 20. As the activator material 14 contacts the circulation valve 20, the expandable material of the valve expands and the holes 21 of the circulation valve 20 restrict. Because the activator material 14 is ahead of the leading edge of the cement composition 15, the holes 21 of the circulation valve 20 are closed before the leading edge of the cement composition 15 comes into contact with the circulation valve 20. Thus, reverse circulation flow through the well bore ceases before little, if any, of the cement composition 15 enters the inside diameter of the casing 4.

In some embodiments of the invention, a certain amount of circulation fluid is injected into the annulus between the activator material 14 and the cement composition 15. Where the expandable material of the circulation valve 20 has a delayed or slow reaction time, the circulation fluid buffer allows the circulation valve enough time to close in advance of the arrival of the leading edge of the cement composition 15 at the valve.

Figure 8:
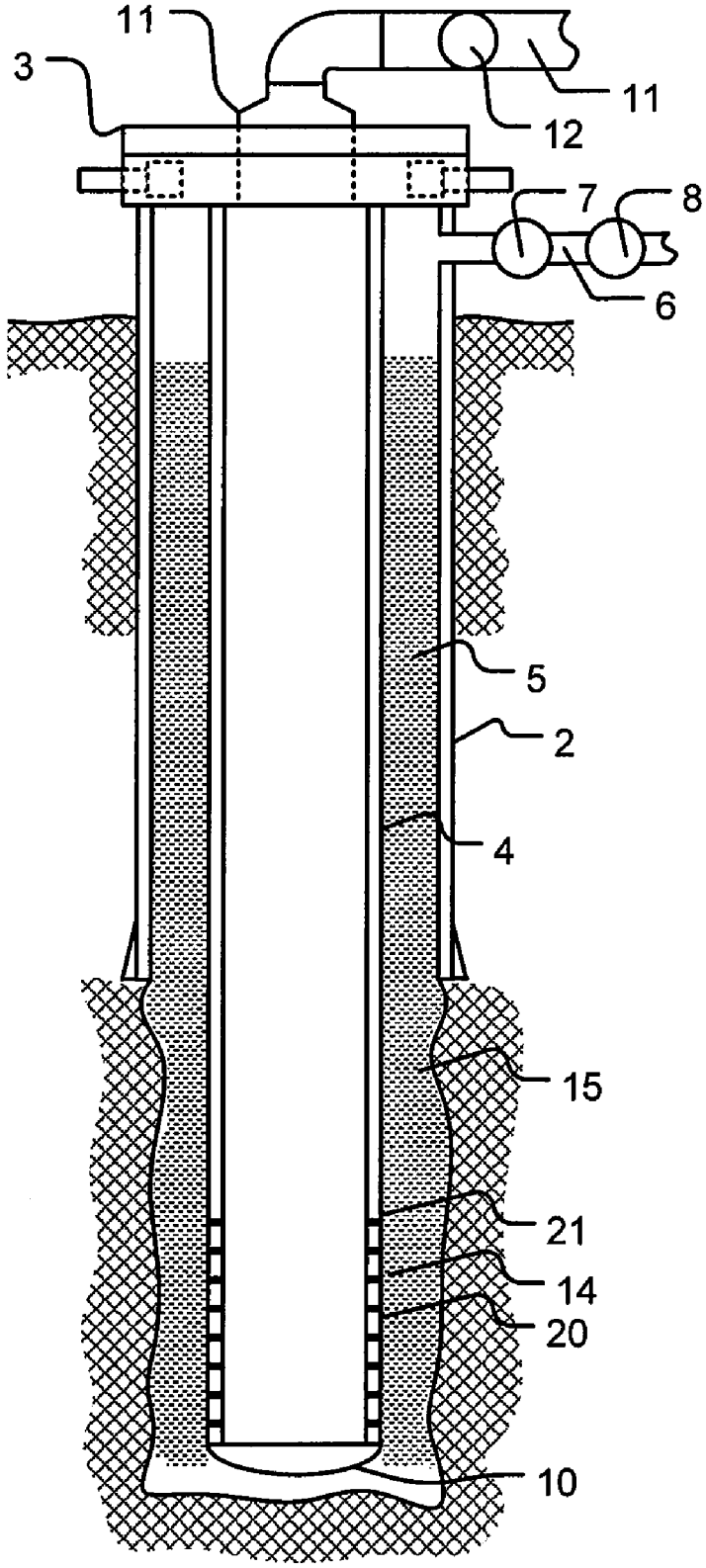
FIG. 8 is a cross-sectional, side view of the well bore shown in FIGS. 6 and 7, wherein the circulation valve is closed and the cement composition is retained in the annulus by the circulation valve.

FIG. 8 is a cross-sectional side view of the well bore shown in FIGS. 6 and 7. In this illustration, the holes 21 of the circulation valve 20 are closed. The cement composition 15 completely fills the annulus 5, but does not fill the inside diameter of the casing 4. As the expandable material of the circulation valve 20 expands to constrict the holes 21, fluid flow through the circulation valve is impeded. In some embodiments of the invention, the circulation valve 20 does not completely cut off circulation, but merely restricts the flow. The operator at the surface will immediately observe an increase in annular fluid pressure and reduced fluid flow as the circulation valve 20 restricts the flow. The operator may use the increased annulus pressure and reduced fluid flow as an indicator to cease pumping cement composition into the annulus.

In some embodiments of the invention, a portion of the circulation valve is coated with a protective coating that is dissolved by the activator material to expose the portion of the circulation valve to the circulation fluid and/or cement composition. In particular, the circulation valve may be a pipe with holes as illustrated in FIG. 2 or a pipe with an expandable plug as illustrated in FIGS. 3A and 3B. Further, the pipe or plug may comprise a material that expands upon contact with water. The pipe or plug may be coated with a water-impermeable material that forms a barrier to insulate and protect the pipe or plug from the circulation fluid in the well bore. The activator material is capable of dissolving or eroding the water-impermeable material from the pipe or plug. Thus, these circulation valves are operated by injecting an activator material into the circulation fluid ahead of the cement composition, so that when the activator material and cement composition are reverse-circulated to the circulation valve, the activator material erodes the protective material to expose the expandable material of the circulation valve to circulation fluid and/or cement composition. This exposure causes the expandable material of the circulation valve to expand, thereby closing the holes of the circulation valve.

For example, the expandable material may be encapsulated in a coating that is dissolvable or degradable in the cement slurry either due to the high pH of the cement slurry or due to the presence of a chemical that is deliberately added to the slurry to release the expandable material from the encapsulated state. Examples of encapsulating materials which breakdown and degrade in the high pH cement slurry include thermoplastic materials containing base-hydrolysable functional groups, for example ester, amides, and anhydride groups. Examples of polymers with such functional groups include polyesters such as polyethylene terephalate (PETE), 3-hydroxybutyrate/3-hydroxyvalerate polymer, lactic acid containing polymer, glycolic acid containing polymers, polycaprolactone, polyethylene succinate, polybutylene succinate, poly(ethylenevinylacetate), poly(vinylacetate), dioxanone containing polymers, cellulose esters, oxidized ethylene carbonmonoxide polymers and the like. Polyesters and polycaprolactone polymers are commercially available under the trade name TONE from Union Carbide Corporation. Suitable polymers containing a carbonate group include polymers comprising bisphenol-A and dicarboxylic acids. Amide containing polymers suitable according to the present invention include polyaminoacids, such as 6/6 Nylon, polyglycine, polycaprolactam, poly(gamma-glutamic acid) and polyurethanes in general. Encapsulating materials which swell upon exposure to high pH fluids include alkali swellable latexes which can be spray dried on to the expandable material in the unswollen acid form. An example of an encapsulating material which require the presence of a special chemical, for example a surfactant, in the cement slurry to expose the encapsulated expandable material to the cement slurry includes polymers containing oxidizable monomers such as butadiene, for example styrene butadiene copolymers, butadiene acrylonitrile copolymers and the like. In alternative embodiments, any encapsulating or coating material known to persons of skill in the art may be used.

Figure 9A:
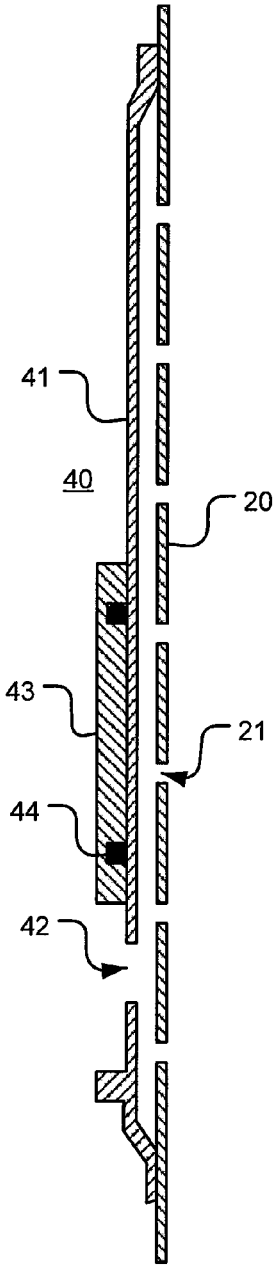
FIG. 9A is a cross-sectional, side view of an isolation sleeve for closing the circulation valve, wherein the isolation sleeve is open.
Figure 9B:
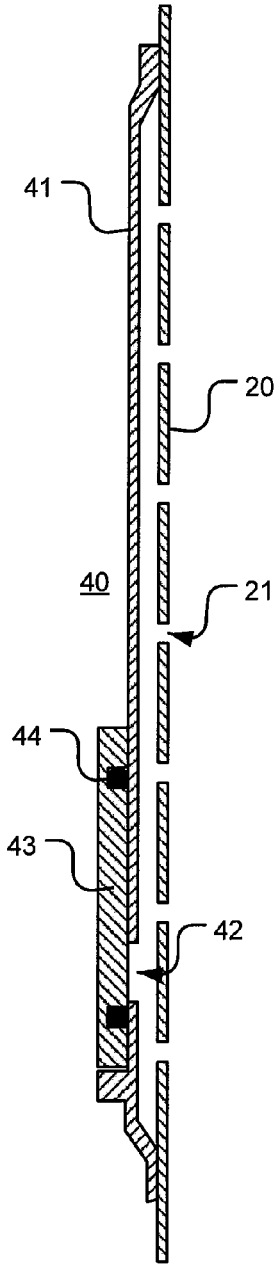
FIG. 9B is a cross-sectional, side view of the isolation sleeve shown in FIG. 9A, wherein the isolation sleeve is closed.

Isolation valves may also be used as part of the invention to ensure that the cement composition is retained in the annulus while the cement composition solidifies. FIGS. 9A and 9B illustrate cross-sectional side views of an isolation sleeve and valve for completely closing the circulation valve 20. In FIG. 9A, the isolation valve 40 is open while in FIG. 9B, the isolation valve 40 is closed. The isolation valve 40 has an isolation sleeve 41 and a sliding sleeve 43. A port 42 allows fluid to pass through the isolation sleeve 41 when the isolation valve 40 is in an open configuration. Seals 44 are positioned between the isolation sleeve 41 and the sliding sleeve 43.

Figure 10A:
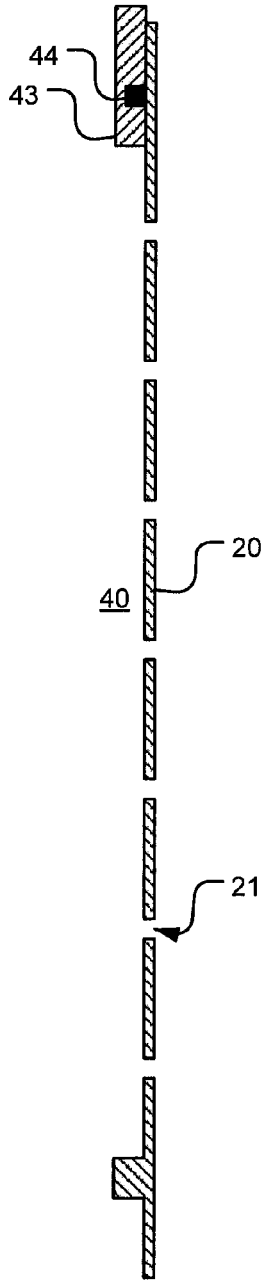
FIG. 10A is a cross-sectional, side view of an alternative isolation sleeve for closing the circulation valve, wherein the isolation sleeve is open.
Figure 10B:
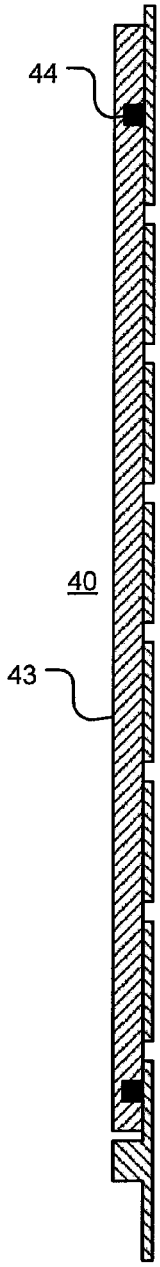
FIG. 10B is a cross-sectional, side view of the isolation sleeve illustrated in FIG. 10A, wherein the isolation sleeve is closed.

FIGS. 10A and 10B illustrate cross-sectional side views of an alternative isolation valve 40. This isolation valve simply comprises a siding sleeve 43, which slides within the inside diameter of the circulation valve 20. In FIG. 10A, the isolation valve 40 is open to allow fluid to flow through the holes 21. In FIG. 10B, the sliding sleeve 43 is positioned over the holes 21 to close the isolation valve 40. Seals 44 are positioned between the sliding sleeve 43 and the circulation valve 20.

Figure 11A:
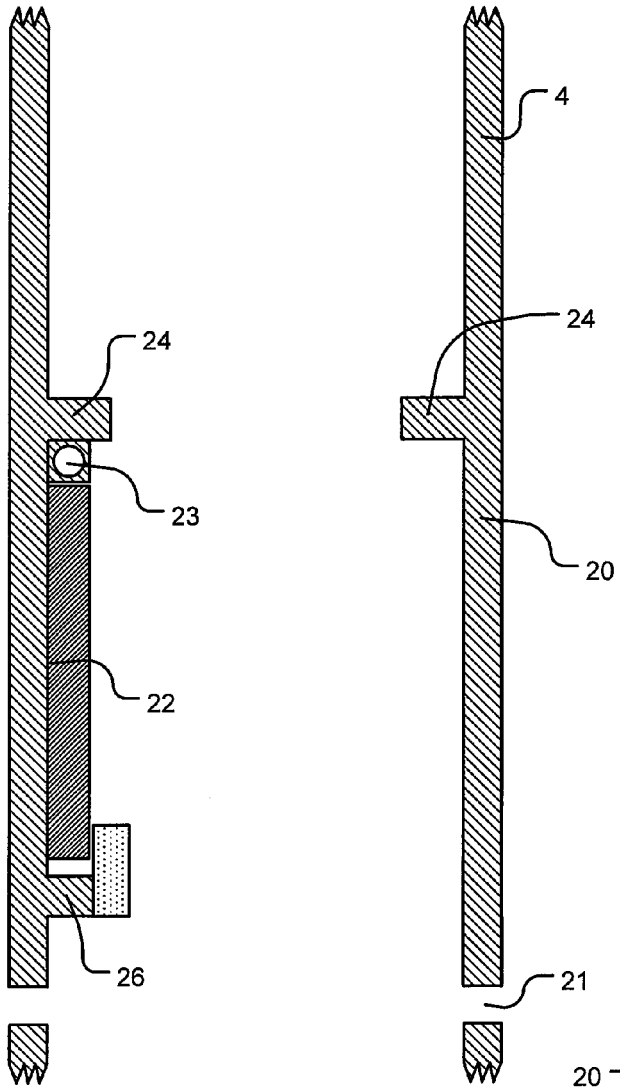
FIG. 11A is a cross-sectional, side view of a circulation valve, having a flapper and a locking mechanism.

Referring to FIG. 11A, a cross-sectional, side view of a circulation valve 20 of the present invention is illustrated. This circulation valve 20 has relatively few large diameter holes 21 to allow fluid to pass from the annulus into the inside diameter of the casing 4. The circulation valve 20 has a flapper 22 connected at a spring hinge 23 to the inside of the circulation valve side wall. A ring seat 24 is also connected to the inner wall of the circulation valve 20 immediately above the spring hinge 23. A valve lock 26 is connected to the inner wall of the circulation valve 20 at a position below the flapper 22. The flapper 22 is held in the open position by the valve lock 26. The spring hinge 23 biases the flapper 22 toward a closed position where the flapper 22 rests firmly against the bottom of the ring seat 24.

Figure 11B:
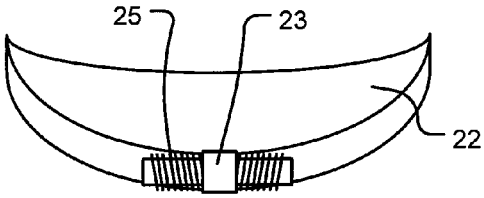
FIG. 11B is an end view of the flapper shown in FIG. 11A.

FIG. 11B illustrates a perspective, end view of the flapper 22 shown in FIG. 11A. The flapper 22 is a disc shaped plate, warped to conform to one side of the inner circumference of the circulation valve 20 when the flapper 22 is in the open position. The flapper 22 has a spring hinge 23 for mounting to the circulation valve and a spring 25 for biasing the flapper 22 into a closed position. As illustrated in FIG. 11A, the flapper 22 is held in an open position by the valve lock 26. When the valve lock 26 is unlocked to release the flapper 22, the flapper 22 rotates counter clockwise about the spring hinge 23 until the flapper 22 becomes seated under the ring seat 24. When the flapper 22 becomes firmly seated under the ring seat 24, the circulation valve 20 is in a closed configuration. Thus, when the flapper 22 is in an open configuration, as illustrated, circulation fluid is allowed to flow freely into the circulation valve 20 through the holes 21 and up through the inside diameter of the circulation valve 20 passed the flapper 22. When the flapper 22 rotates to a closed position on the ring seat 24, fluid flow up through the interior of the circulation valve 20 and into the inner diameter of the casing 4 is completely stopped. Flapper valve are commercially available and known to persons of skill in the art. These flapper valves may be modified to comprise a valve lock as described more fully below.

Figure 12:
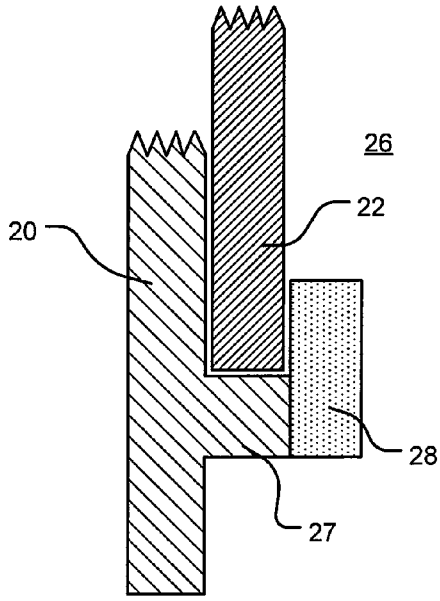
FIG. 12 is a cross-sectional, side view of an embodiment of the locking mechanism identified in FIG. 11A, wherein the locking mechanism comprises dissolvable material.

Referring to FIG. 12, a cross-sectional side view is shown of an embodiment of the valve lock 26 illustrated in FIG. 11A. The valve lock 26 has a flange 27 extending from the side wall of the circulation valve 20. Reactive material 28 is positioned at the interior, distal end of the flange 27. The free end of the flapper 22, in an open configuration, is locked between the side wall of the circulation valve 20 and the reactive material 28. In this embodiment, the circulation valve 20 is unlocked by causing an activator material to contact the reactive material 28. The activator material causes the reactive material 28 to dissolve or otherwise lose its structural integrity until it is no longer able to retain the flapper 22 in the open configuration. Examples of reactive material 28 include aluminum and magnesium that react with any high pH fluid (activator material) to dissolve. In alternative embodiments, any reactive material known to persons of skill may be used. Because the flapper 22 is spring biased toward the closed position, the flapper 22 urges itself against the reactive material 28. As the reactive material 28 is weakened by the activator material, it eventually fails to maintain its structural integrity and releases the flapper 22. The flapper 22 then rotates to the closed position.

In an alternative embodiment, the flapper 22 is held in the open position by a glue (reactive material) that dissolves upon contact with an activator material. The glue is any type of sticky or adhesive material that holds the flapper 22 in the open position. Upon contact by the activator material, the glue looses its adhesive property and releases the flapper 22. Any adhesive known to persons of skill in the art may be used.

In an alternative embodiment of the valve lock 26, illustrated in FIG. 12, the activator material causes the reactive material 28 to shrink or reduce in size so that the flapper 22 is no longer retained by the reactive material 28. When the reactive material 28 becomes too short or small, the flapper 22 is freed to move to the closed position. Any shrinkable reactive material known to persons of skill in the art may be used.

Figure 13:
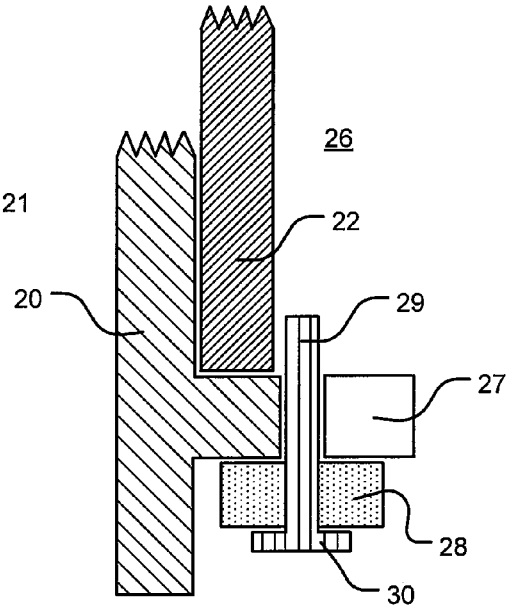
FIG. 13 illustrates a cross-sectional, side view of the locking mechanism identified in FIG. 11A, wherein the locking mechanism comprises expandable material.

FIG. 13 illustrates a cross-sectional side view of an alternative valve lock 26 identified in FIG. 11A. In this embodiment of the invention, the valve lock 26 has a flange 27 extending from the side wall of the circulation valve 20. The free end of the flapper 22 is retained in an open configuration by a lock pin 29. The lock pin 29 extends through a hole in the flange 27. The lock pin 29 also extends through reactive material 28 positioned between a head 30 of the lock pin 29 and the flange 27. In this embodiment, the valve lock 27 unlocks when an activator material contacts the reactive material 28. This reactive material 28 expands between the head 30 of the lock pin 29 and the flange 27. Upon expansion of the reactive material 28, the lock pin 29 is pulled downward through the hole in the flange 27 until it no longer extends above the flange 27. Because the flapper 22 is biased to a closed position, when the lock pin 29 is pulled downward to the point where it clears the free end of the flapper 22, the flapper 22 is released to rotate to its closed position. Expandable materials previously disclosed may also work in this embodiment of the invention.

Figure 14A:
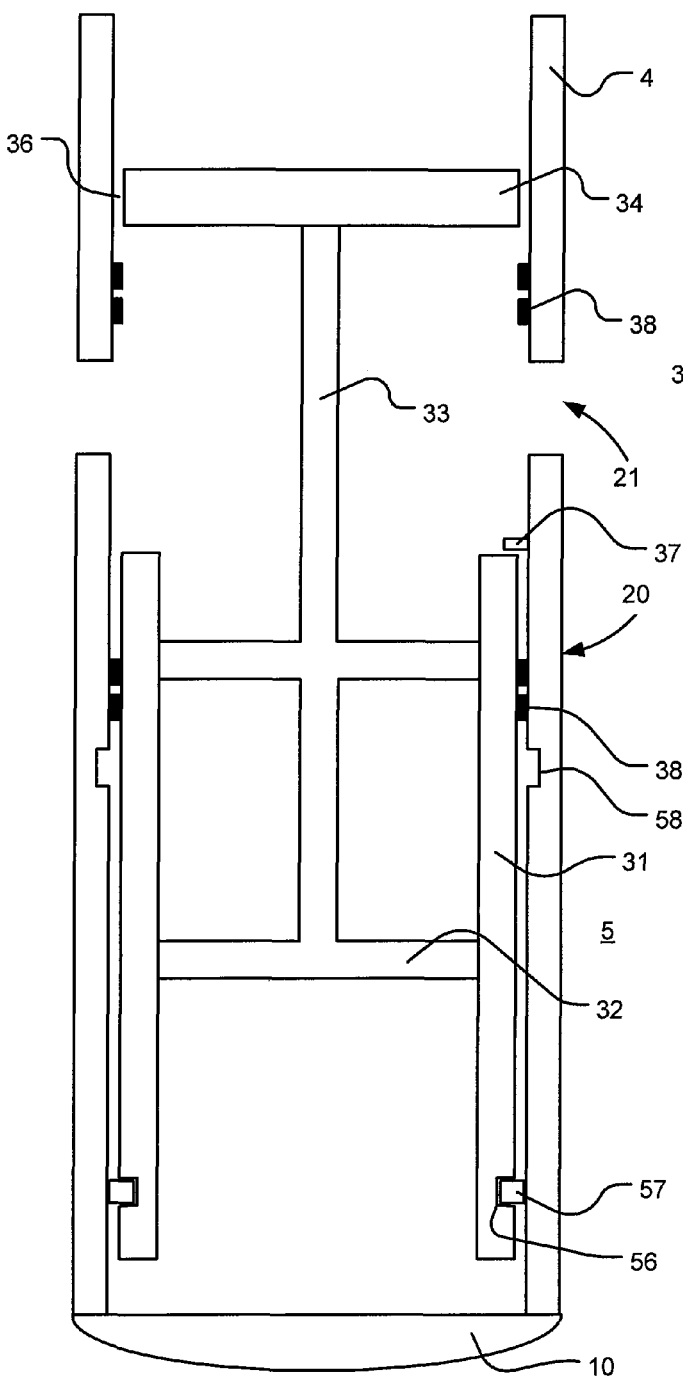
FIG. 14A illustrates a cross-sectional, side view of a sliding sleeve embodiment of a circulation valve having a restrictor plate.

Referring to FIG. 14A, a cross-sectional side view is illustrated of a sliding sleeve embodiment of the invention. This circulation valve 20 has holes 21 through the sidewall of the casing 4, which allows fluid to flow between the annulus 5 and the inner diameter of the casing 4. The bottom of the casing 4 is closed by the casing shoe 10. A sliding sleeve 31 is positioned within the casing 4. A support frame 32 is configured within the sliding sleeve 31. A support rod 33 extends from the support frame 32. A restrictor plate 34 is attached to the distal end of the support rod 33.

Figure 14B:
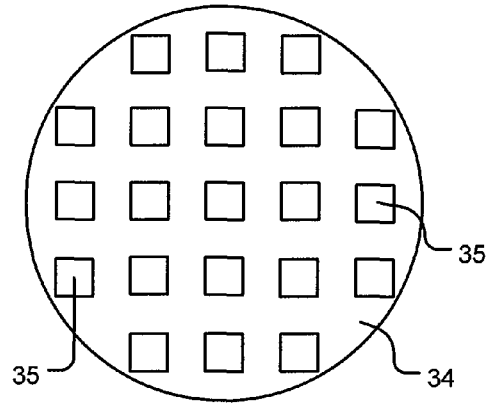
FIG. 14B illustrates a top view of a restrictor plate identified in FIG. 14A, wherein the restrictor plate has expandable material for closing the circulation valve.

FIG. 14B shows a top view of the restrictor plate 34 of FIG. 14A. The restrictor plate 34 has a plurality of holes 35 that allow fluid to flow through the restrictor plate 34. The restrictor plate 34 is may comprise an expandable material that expands upon contact with an activator material. Expandable materials previously disclosed may also work in this embodiment of the invention. In alternative embodiments the restrictor plate 34 may comprise a reactive material that is a temperature sensitive material that expands with changes in temperature. Exothermic or endothermic chemical reactions in the well bore may then be used to activate the temperature sensitive reactive material 28 of the restrictor plate.

The circulation valve 20 of FIG. 14A is run into the well bore in an open configuration to allow fluid to freely flow between the annulus 5 and the inner diameter of the casing 4. In a reverse-circulation direction, the fluid flows from the holes 21 up through the inner diameter of the casing 4 through and around the restrictor plate 34. The outside diameter of the restrictor plate 34 is smaller than the inner diameter of the casing 4. In operation, the circulation valve 20 is closed by contact with an activator material. While circulation fluid flows through the circulation valve 20, the circulation fluid flows freely through the holes 35 of the restrictor plate 34 and also through an annular gap 36 between the circumference of the restrictor plate 34 and the inner diameter of the casing 4. When an activator material contacts the restrictor plate 34, the material of the restrictor plate 34 expands so that the holes 34 constrict and the gap 36 narrows. As these flow spaces constrict, fluid pressure below the restrictor plate 34 increases relative to the fluid pressure above the restrictor plate 34 (assuming a reverse-circulation fluid flow direction). This pressure differential pushes the restrictor plate 34 in an upward direction away from the holes 21. Because the restrictor plate 34 is connected to the sliding sleeve 31 by the support frame 32 and support rod 33, the sliding sleeve 31 is also pulled upward. The sliding sleeve 31 continues its upward travel until the sliding sleeve 31 covers the holes 21 and engages the seals 38 above and below the holes 21. In certain embodiments of the invention, the sliding sleeve 31 is retained in an open configuration by a shear pin 37. The shear pin 37 ensures that a certain pressure differential is required to close the circulation valve 20. The circulation valve 20 is closed as the restrictor plate 32 pulls the sliding sleeve 31 across the holes 21. Seals 38 above and below the holes 21 mate with the sliding sleeve 31 to completely close the circulation valve 20.

In some embodiments, the sliding sleeve valve also has an automatic locking mechanism which locks the sliding sleeve in a closed position. In FIG. 14A, the automatic locking mechanism is a lock ring 57 that is positioned within a lock groove 56 in the exterior of the sliding sleeve 31. The lock ring 57, in an uncompressed state, is larger in diameter than the inner diameter of the casing 4. Thus, when the lock ring 57 is positioned within the lock groove 56, the lock ring 57 urges itself radially outward to press against the inner diameter of the casing 4. When the sliding sleeve 31 is moved to its closed position, the lock ring 57 snaps in a snap groove 58 in the inner diameter of the casing 4. In this position, the lock ring 57 engages both the lock groove 56 and the snap groove 58 to lock the sliding sleeve 31 in the closed position. In alternative embodiments, the automatic locking mechanism is a latch extending from the sliding sleeve, or any other locking mechanism known to persons of skill.

In an alternative embodiment, the restrictor plate 34 of FIG. 14A is replaced with a basket similar to the baskets 70 described relative to FIGS. 4, 5A and 5B. This basket has the same shape as the restrictor plate 34 and is filed with particulate expandable material. When the expandable material in the basket is activated, the particles expand to occupy the void spaces between the particles. This expansion restricts fluid flow through the basket causing the sliding sleeve 31 (see FIG. 14A) to be closed.

In a further embodiment, the restrictor plate is rigid structure. Rather than expanding the material of the restrictor plate, a particulate material is circulated in a slurry down the annulus and in through the holes 21. The particulate material is collected or accumulated at the underside of the restrictor plate so as to form a cake. The cake of particulate material restricts fluid flow through and around the restrictor plate so that fluid pressure building behind the restrictor plate pushes the restrictor plate and sliding sleeve to a closed position.

Figure 15:
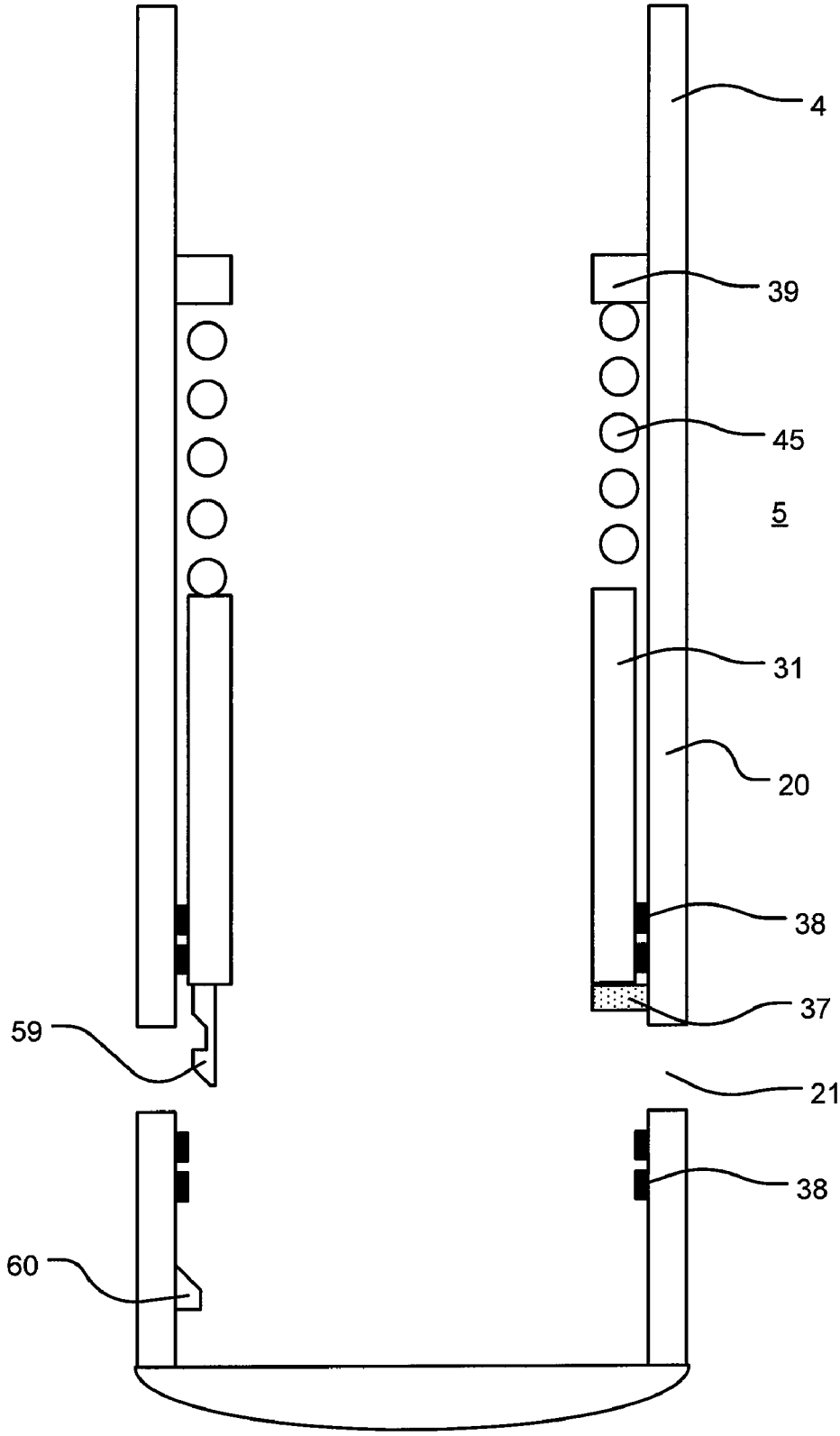
FIG. 15 is a cross-sectional, side view of an alternative sliding sleeve circulation valve wherein the locking mechanism comprises dissolvable or shrinkable material.

FIG. 15 illustrates an alternative sliding sleeve embodiment of the invention having a spring loaded sliding sleeve shown in a cross-sectional, side view. The circulation valve 20 has holes 21 in the casing side walls to allow fluid to communicate between the annulus 5 and the inside diameter of the casing 4. A sliding sleeve 31 is positioned within the casing 4. A block flange 39 extends from the inner diameter of the casing 4. A spring 45 is positioned within the casing 4 between the block flange 39 and the sliding sleeve 31 to bias the sliding sleeve 31 to move in a downward direction. When the circulation valve 20 is in an open configuration, as illustrated, the spring 45 is compressed between the block flange 39 and the sliding sleeve 31. The sliding sleeve 31 is held in the open configuration by a shear pin 37. In this embodiment of the invention, the shear pin 37 may comprise a dissolvable material that dissolves upon contact with an activator material. As noted above, materials such as aluminum and magnesium dissolve in high pH solutions and may be used in this embodiment of the invention. Further, the shear pin 37 is positioned within the circulation valve so as to contact circulation fluid and/or activator material as these fluids flow from the annulus 5, through the holes 21 and into the inner diameter of the casing 4 (assuming a reverse-circulation fluid flow direction). In an alternative embodiment, the shear pin 37 may comprise a shrinkable material that becomes small enough for the sliding sleeve 31 to slip past.

The circulation valve 20 of FIG. 15 closes when a sufficient amount of activator material has eroded the shear pin 37 such that the downward force induced by the spring 45 overcomes the structural strength of the shear pin 37. Upon failure of the shear pin 37, the spring 45 drives the sliding sleeve 31 from the open configuration downward to a closed configuration wherein the sliding sleeve 31 spans the holes 21. In the closed configuration, the sliding sleeve 31 engages seals 38 above and below the holes 21. This sliding sleeve may also have a locking mechanism to lock the sleeve in a close position, once the sleeve has moved to that position. FIG. 15 illustrates a locking mechanism having a lock finger 59 that engages with a lock flange 60 when the sliding sleeve 31 moves to its closed position. Any locking mechanism known to persons of skill may be used.

Figure 16:
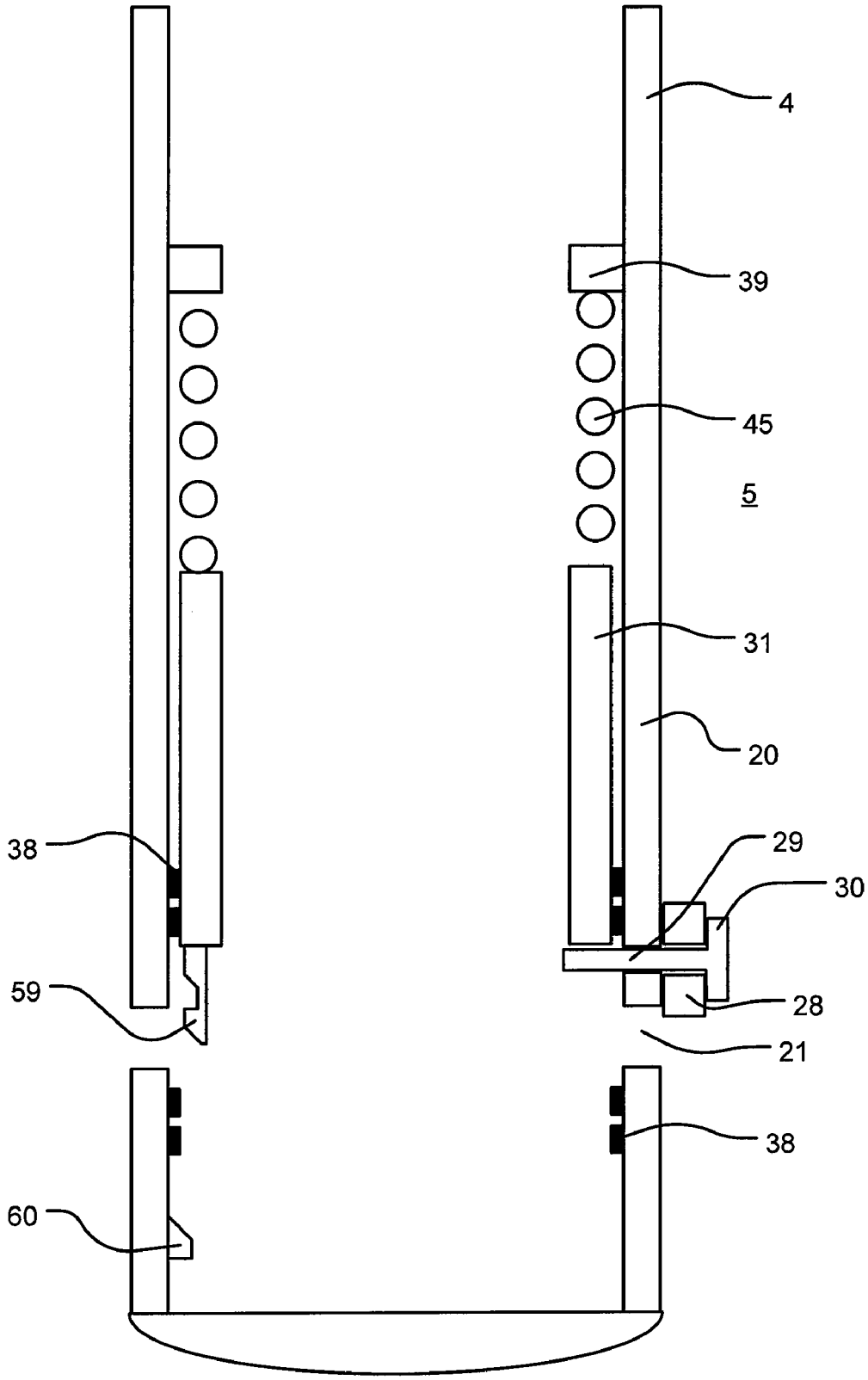
FIG. 16 is a cross-sectional, side view of an alternative sliding sleeve circulation valve wherein the locking mechanism comprises expandable material.

FIG. 16 illustrates an alternative sliding-sleeve, circulation valve, wherein expandable reactive material is used to unlock the lock. In particular, the sliding sleeve 31 is biased to a closed position by a spring 45 pressing against a block flange 41. The sliding sleeve is held in the open position by a lock pin 29, wherein the lock pin 29 extends through a sidewall in the casing 4. A portion of reactive material 28 is positioned between the casing 4 and a head 30 of the lock pin 29. When an activator material contacts the reactive material 28, it expands to drive the lock pin 29 from contact with the sliding sleeve 31 so that the spring 45 is able to drive the sliding sleeve 31 to its closed position. Expandable materials previously disclosed may also be used with this embodiment of the invention. A lock finger 59 then engages with a lock flange 60 to retain the sliding sleeve 31 in the closed position.

Alternative sliding sleeve valves may also be used with the invention. While the above-illustrated sliding sleeve is biased to the closed position by a spring, alternative embodiments may bias the sliding sleeve by a pre-charged piston, a piston that charges itself by external fluid pressure upon being run into the well bore, magnets, or any other means known to persons of skill.

Figure 17:
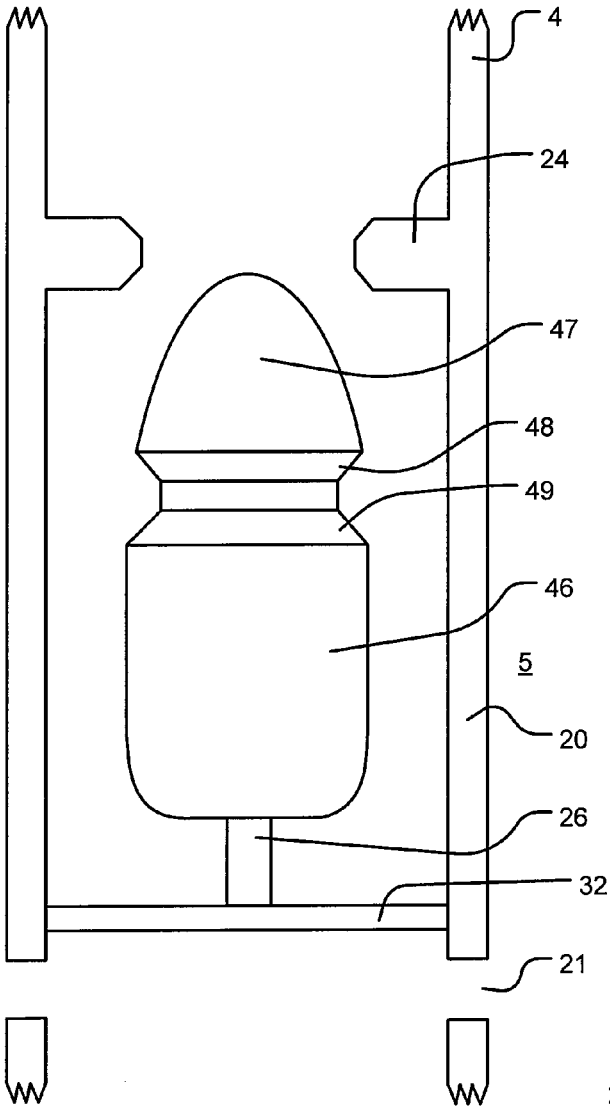
FIG. 17 illustrates a cross-sectional, side view of a circulation valve having a float plug and valve lock.

FIG. 17 illustrates a cross-sectional, side view of an embodiment of the invention wherein the circulation valve includes a float plug. The circulation valve 20 is made up to or otherwise connected to the casing 4 such that holes 21 permit fluid to pass between an annulus 5 and the inside diameter of the casing 4. The circulation valve 20 also has a ring seat 24 that protrudes inwardly from the inside walls of the casing 4. A float plug 46 is suspended within the circulation valve 20. An upper bulbous point 47 is filled with a gas or other low-density material so that the float plug 46 will float when submerged in circulation fluid. A support frame 32 extends from the interior side walls of the casing 4. The float plug 46 is anchored to the support frame 32 by a valve lock 26. Because the float plug 46 floats when submerged in circulation fluid, the float plug 46 is pushed upwardly in the circulation valve 20 by the surrounding fluids. The float plug 46 is held in the open position, as illustrated, by the support frame 32 and valve lock 26. When the circulation valve 20 is unlocked to move to a closed position, the float plug 46 moves upward relative to the ring seat 24 so that the bulbous point 47 passes through the center of the ring seat 24. The float plug 46 continues its upward travel until a lock shoulder 48 of the float plug 46 snaps through the opening in the ring seat 24 and a seal shoulder 49 rests firmly on the bottom side of the ring seat 24. The lock shoulder 48 is made of a resilient and/or flexible material to allow the bulbous point 47 to snap through the ring seat 24 and also to retain or lock the float plug 46 in the closed position once the valve has closed. The valve is held in an open position by the valve lock 26. When the valve lock 26 is activated, the float plug 46 is released from the support frame 32 so as to float upwardly to a closed position.

Figure 18:
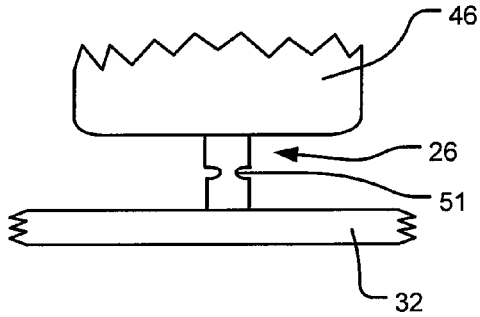
FIG. 18 is a cross-sectional, side view of the valve lock identified in FIG. 17, wherein the valve lock comprises dissolvable material.

Referring to FIG. 18, an embodiment is illustrated of the valve lock 26 of FIG. 17. The valve lock 26 anchors the float plug 46 to the support frame 32. In this embodiment, the valve lock 26 comprises a dissolvable material that dissolves upon contact with an activator material. Aluminum and magnesium, which dissolve in high pH solutions, may be used with this embodiment of the invention. The valve lock 26 has a neck 51 wherein the diameter and surface area of the neck 51 is designed to dissolve at a particular rate. Therefore, the valve lock 26 may be designed to fail or fracture at the neck 51 according to a predictable failure schedule upon exposure to the activator material. Once the valve lock 26 fractures at the neck 51, the float plug 46 is freed to float to a closed position.

Figure 19:
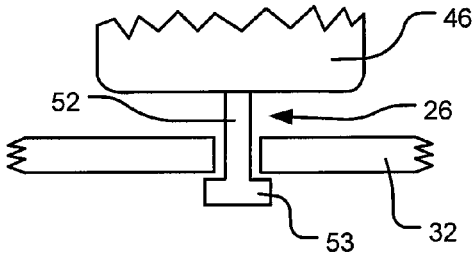
FIG. 19 is a cross-sectional, side view of the valve lock identified in FIG. 17, wherein the valve lock comprises a shrinkable material.

Referring the FIG. 19, a cross-sectional, side view is shown of an alternative valve lock 26 identified in FIG. 17. The valve lock 26 anchors the float plug 46 to the support frame 32. This particular valve lock 26 comprises a long pin or rod 52 which extends through a hole in the support frame 32. Below the support frame 32, the valve lock 26 has a head 53 that is larger than the hole in the support frame 32. When the head 53 of the valve lock 26 is exposed to an activator material, the head 53 shrinks or reduces in size. When the outside diameter of the head 53 becomes smaller than the inside diameter of the hole through the support frame 32, the float plug 46 pulls the valve lock 26 through the hole in the support frame 32. Thereby, the float plug 46 becomes unlocked from its open position.

Figure 20:
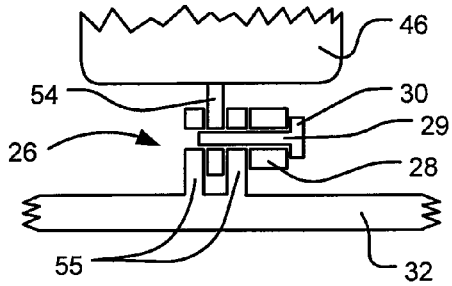
FIG. 20 illustrates a cross-sectional, side view of the valve lock identified in FIG. 17, wherein the valve lock comprises expandable material.

Referring to FIG. 20, a cross-sectional, side view is shown of an alternative valve lock 26 identified in FIG. 17. The float plug 46 is anchored to the support frame 32 by the valve lock 26. The valve lock 26 has a clevis 54 that extends downwardly from the float plug 46, a pair of flanges 55 that extend upwardly from the support frame 32, a ring of active material 28, and a lock pin 29. The lock pin 29 has a shaft that extends through the reactive material 28, the flanges 55 and the clevis 54. The clevis 54 is positioned between the pair of flanges 55 to ensure that the clevis 54 does not slip off the lock pin 29. The lock pin 29 also has a head 30 at one end such that the ring of reactive material 28 is sandwiched between the head 30 and a flange 55. The valve lock 26 becomes unlocked when the reactive material 28 becomes exposed to an activator material, whereby the reactive material 28 expands. Any of the expandable materials disclosed herein may be used with this embodiment of the invention. As the reactive material 28 expands, the reactive material 28 pushes the head 30 of the pin 29 away from the flange 55. The expanding reactive material 28 causes the lock pin 29 to withdraw from the clevis 54 so that the float plug 46 and clevis 54 are released from the flanges 55. Thus, the float plug 46 is unlocked by the valve lock 26 from its open position.

Figure 21:
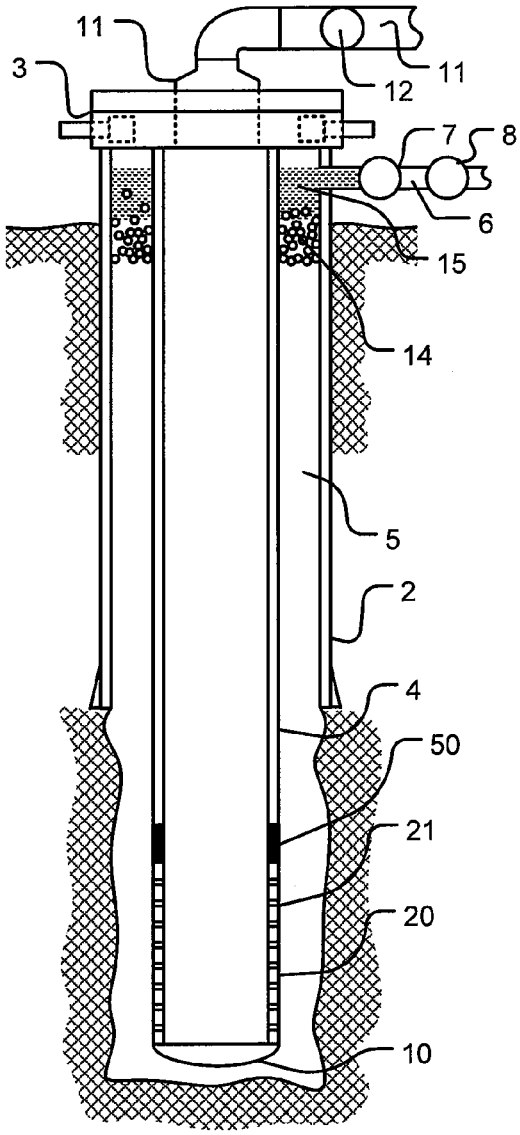
FIG. 21 illustrates a cross-sectional, side view of a well bore having casing suspended from a wellhead, and a packer attached to the casing immediately above holes in the casing, wherein a reactive material and a cement composition are shown being pumped into the annulus at the wellhead.

Referring to FIG. 21, a cross-sectional, side view of an embodiment of the invention is shown having a packer that is activated by an activator material. Well bore 1 is shown in cross-section with a surface casing 2 and attached well head 3. A casing 4 is suspended from the well head 3 and defines an annulus 5 between the casing 4 and the well bore 1. At the bottom end of the casing 4, a circulation valve 20 allows fluid to flow between the annulus 5 and the inside diameter of the casing 4. A packer 50 is positioned in the casing 4 immediately above the circulation valve 20.

Figure 22:
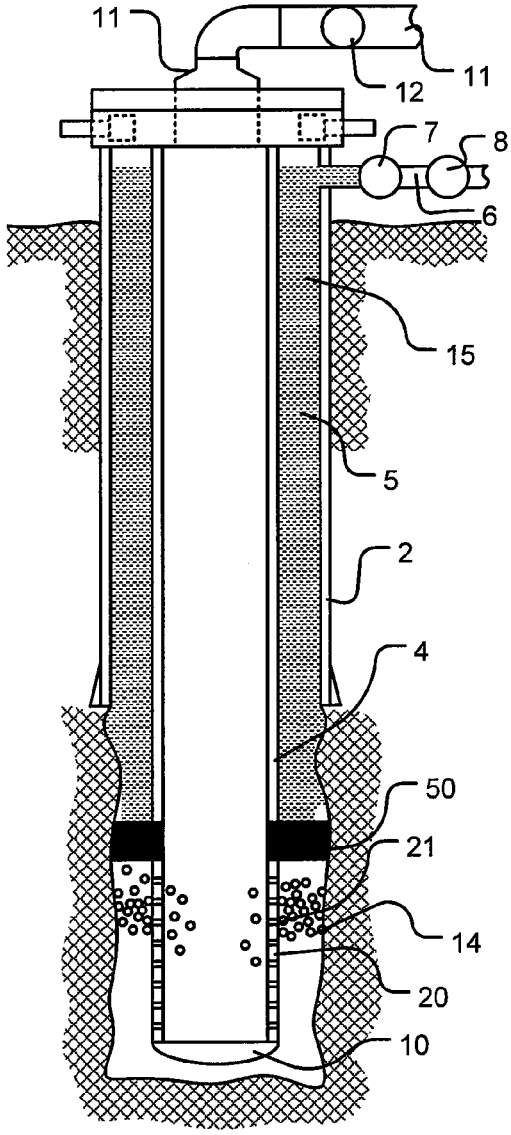
FIG. 22 is a cross-sectional, side view of the well bore illustrated in FIG. 21, wherein the activator material has activated the packer to expand in the annulus, whereby the packer retains the cement composition in the annulus.

The operation of the packer 50 is illustrated with reference to FIGS. 21 and 22, wherein FIG. 22 is a cross-sectional, side view of the well shown in FIG. 21. In FIG. 21, an activator material 14 is pumped into the annulus 5 through a feed line 6. Behind the activator material 14, cement composition 15 is also pumped through the feed line 6. As shown in FIG. 17, the activator material 14 and cement composition 15 descend in the annulus 5 until the activator material 14 contacts the packer 50. As the activator material 14 contacts the packer 50, the packer 50 expands in the annulus 5 to restrict the fluid flow through the annulus 5 (see FIG. 22). Much, if not all of the activator material 14 passes by the packer 50 as the packer expands. However, by the time the cement composition 15 begins to flow pass the packer 50 through the annulus 5, the packer 50 has expanded sufficiently to significantly restrict or completely block fluid flow through the annulus 5. Thus, the packer 50 restricts or prevents the cement composition 15 from entering into the inner diameter of the casing 4 through the circulation valve 20 by restricting fluid flow through the annulus 5.

Figure 23A:
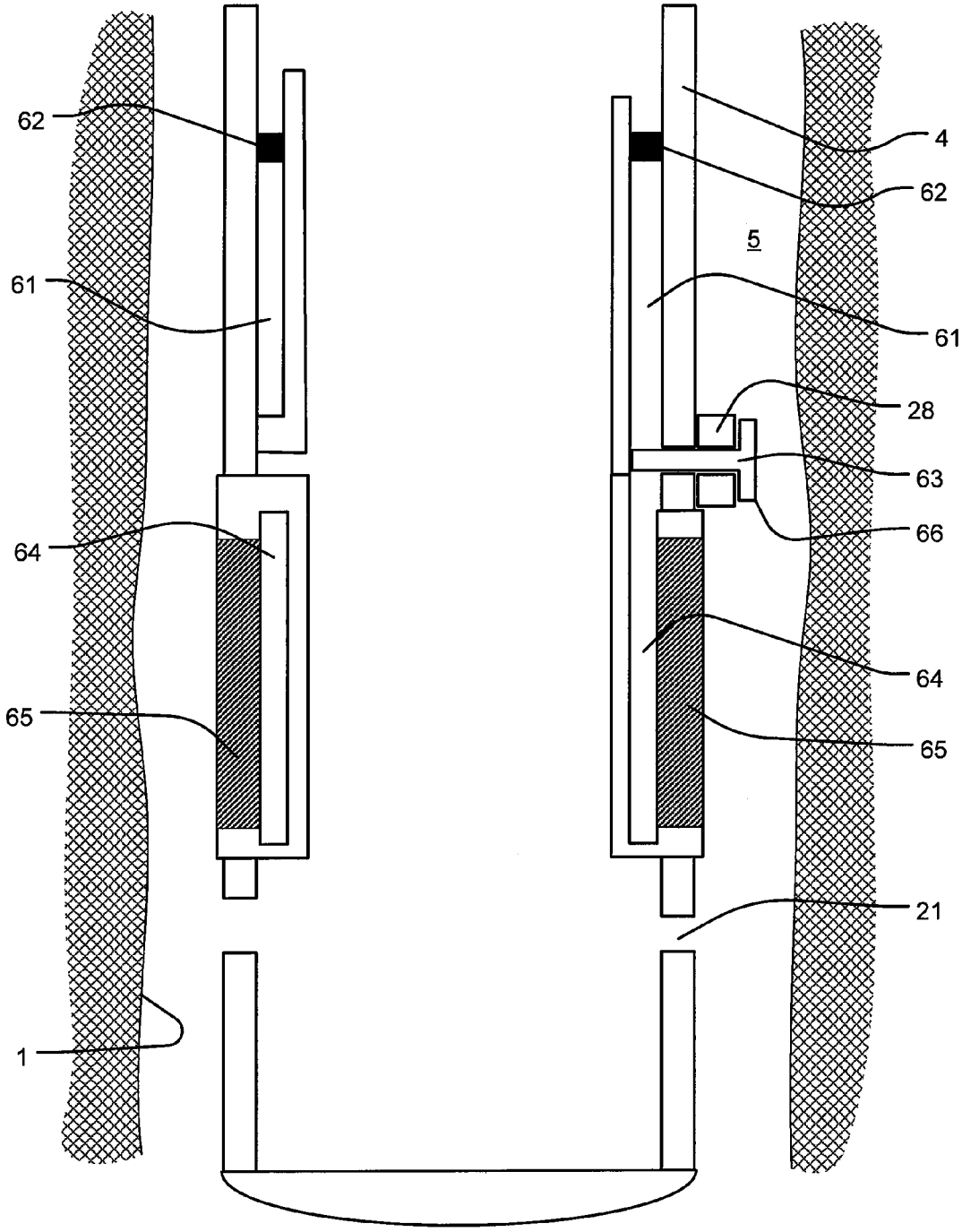
FIG. 23A is a cross-sectional, side view of the packer identified in FIGS. 21 and 22, wherein the packer is shown in a pre-expanded configuration.

FIG. 23A illustrates a cross-sectional, side view of the packer 50, identified in FIGS. 21 and 22. The packer 50 has a charge chamber 61 and an annular-shaped charge piston 62. As the packer 50 is run into the well bore 1 on the casing 4, the increasing ambient fluid pressure drives the charge piston 62 into the charge chamber 61. However, the increased gas pressure is retained in the charge chamber 61 by a pressure pin 63. The pressure pin 63 has a head 66. A portion of reactive material 28 is positioned between the casing 4 and the head 66 of the pressure pin 63. Thus, when an activator material contacts the reactive material 28, the reactive material 28 expands to pull the pressure pin 63 from the charge chamber 61. Any of the expandable materials disclosed herein may be used with this embodiment of the invention.

The packer 50 also has a fill chamber 64 and a packer element 65 positioned below the charge chamber 61. The packer element 65 is an annular-shaped, elastic structure that is expandable to have an outside diameter larger than the casing 4. When the pressure pin 63 is opened, charged gas from the charge chamber 61 is allowed to bleed past the pressure pin 63 into the fill chamber 64. The charge gas in the fill chamber 64 expands the packer element 65.

Figure 23B:
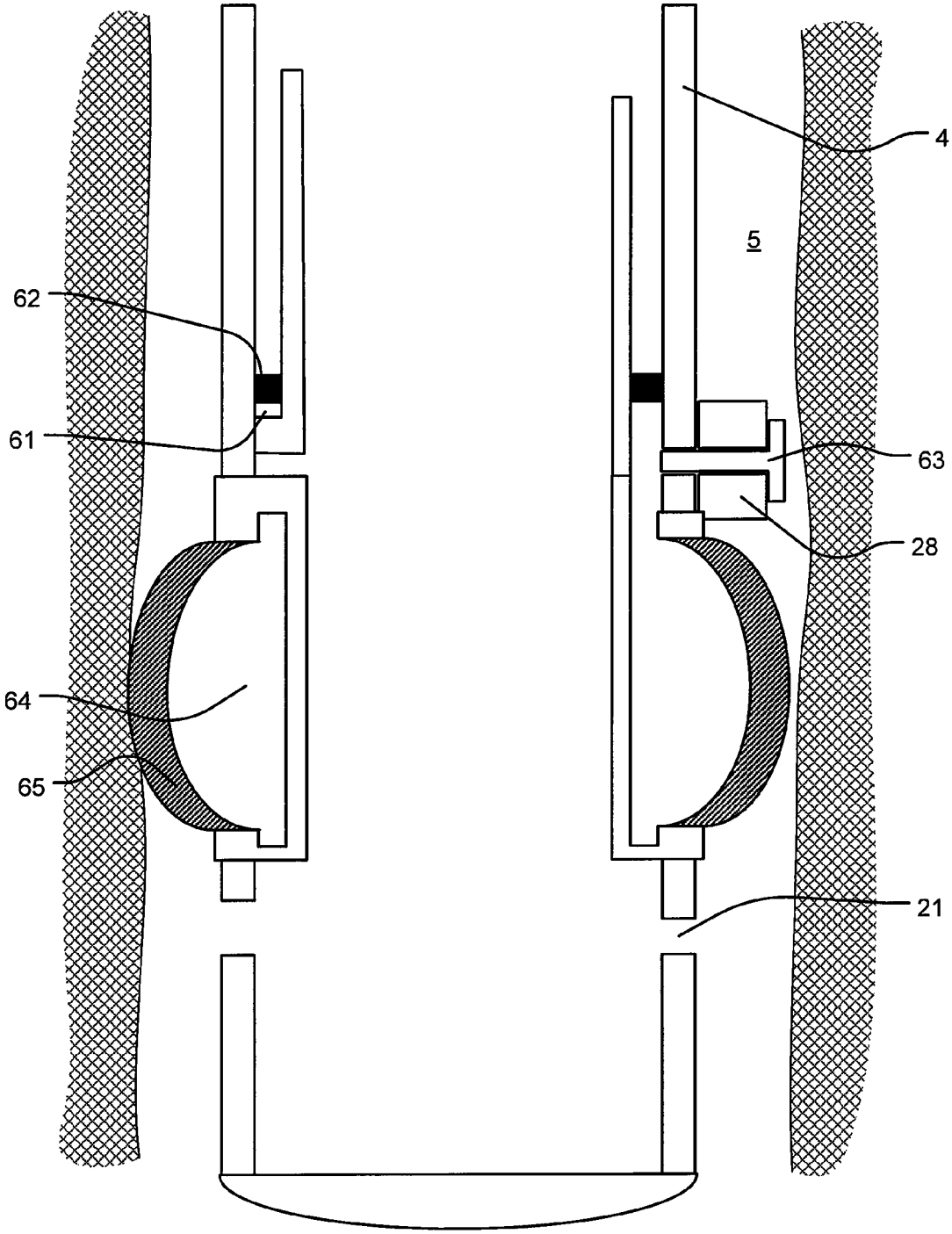
FIG. 23B is a cross-sectional, side view of the packer identified in FIGS. 21 and 22, wherein the packer is shown in an expanded configuration.

A cross-sectional, side view of the packer 50 of FIG. 23A is illustrated in FIG. 23B, wherein the packer element is expanded. The charge piston 62 is pushed almost all the way down to the pressure pin 63 by increased well bore hydrostatic pressure. The reactive material 28 is expanded to pull the pressure pin 63 from its place between the charge chamber 61 and the fill chamber 64. The packer element 65 is expanded into the annulus 5. In the illustrated configuration, the packer element 65 restricts or prevents fluids from flowing up and down through the annulus 5.

In alternative embodiments, various packer elements which are known to persons of skill are employed to restrict fluid flow through the annulus. These packer elements, as used in the present invention, have a trigger or initiation device that is activated by contact with an activator material. Thus, the packer may be a gas-charge, balloon-type packer having an activator material activated trigger. Once the trigger is activated by contact with an activator material, the trigger opens a gas-charged cylinder to inflate the packer. Packers and triggers known to persons of skill may be combined to function according to the present invention. For example, inflatable or mechanical packers such as external cam inflatable packers (ECIP), external sleeve inflatable packer collars (ESIPC), and packer collars may be used.

Various embodiments of the invention use micro spheres to deliver the activator material to the circulation valve. Microspheres containing an activator material are injected into the leading edge of the cement composition being pumped down the annulus. The microspheres are designed to collapse upon contact with the circulation valve. The microspheres may also be designed to collapse upon being subject to a certain hydrostatic pressure induced by the fluid column in the annulus. These microspheres, therefore, will collapse upon reaching a certain depth in the well bore. When the microspheres collapse, the activator material is then dispersed in the fluid to close the various circulation valves discussed herein.

In the illustrated well bore configurations, the circulation valve is shown at the bottom of the well bore. However, the present invention may also be used to cement segments of casing in the well bore for specific purposes, such as zonal isolation. The present invention may be used to set relatively smaller amounts of cement composition in specific locations in the annulus between the casing and the well bore.

Further, the present invention may be used in combination with casing shoes that have a float valve. The float valve is closed as the casing is run into the well bore. The casing is filled with atmospheric air or a lightweight fluid as it is run into the well bore. Because the contents of the casing weigh less than the fluid in the well bore, the casing floats in the fluid so that the casing weight suspended from the derrick is reduced. Any float valve known to persons of skill may be used with the present invention, including float valves that open upon bottoming out in the rat hole.

The reactive material and the activator material may comprise a variety of compounds and material. In some embodiments of the invention, xylene (activator material) may be used to activate rubber (reactive material). Radioactive, illuminating, or electrical resistivity activator materials may also be used. In some embodiments, dissolving activator material, like an acid (such as HCL), may be pumped downhole to activate a dissolvable reactive material, such as calcium carbonate. Nonlimiting examples of degradable or dissolvable materials that may be used in conjunction with embodiments of the present invention having a degradable or dissolvable valve lock or other closure mechanism include but are not limited to degradable polymers, dehydrated salts, and/or mixtures of the two.

The terms "degradation" or "degradable" refer to both the two relatively extreme cases of hydrolytic degradation that the degradable material may undergo, i.e., heterogeneous (or bulk erosion) and homogeneous (or surface erosion), and any stage of degradation in between these two. This degradation can be a result of, inter alia, a chemical or thermal reaction or a reaction induced by radiation. The degradability of a polymer depends at least in part on its backbone structure. For instance, the presence of hydrolyzable and/or oxidizable linkages in the backbone often yields a material that will degrade as described herein. The rates at which such polymers degrade are dependent on the type of repetitive unit, composition, sequence, length, molecular geometry, molecular weight, morphology (e.g., crystallinity, size of spherulites, and orientation), hydrophilicity, hydrophobicity, surface area, and additives. Also, the environment to which the polymer is subjected may affect how it degrades, e.g., temperature, presence of moisture, oxygen, microorganisms, enzymes, pH, and the like.

Suitable examples of degradable polymers that may be used in accordance with the present invention include but are not limited to those described in the publication of Advances in Polymer Science, Vol. 157 entitled "Degradable Aliphatic Polyesters" edited by A. C. Albertsson. Specific examples include homopolymers, random, block, graft, and star- and hyper-branched aliphatic polyesters. Polycondensation reactions, ring-opening polymerizations, free radical polymerizations, anionic polymerizations, carbocationic polymerizations, coordinative ring-opening polymerization, and any other suitable process may prepare such suitable polymers. Specific examples of suitable polymers include polysaccharides such as dextran or cellulose; chitins; chitosans; proteins; aliphatic polyesters; poly(lactides); poly(glycolides); poly(c-caprolactones); poly(hydroxybutyrates); poly(anhydrides); aliphatic polycarbonates; ortho esters, poly(orthoesters); poly(amino acids); poly(ethylene oxides); and polyphosphazenes.

Aliphatic polyesters degrade chemically, inter alia, by hydrolytic cleavage. Hydrolysis can be catalyzed by either acids or bases. Generally, during the hydrolysis, carboxylic end groups are formed during chain scission, and this may enhance the rate of further hydrolysis. This mechanism is known in the art as "autocatalysis," and is thought to make polyester matrices more bulk eroding. Suitable aliphatic polyesters have the general formula of repeating units shown below:

Formula I

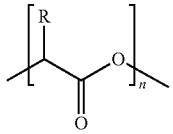

where n is an integer between 75 and 10,000 and R is selected from the group consisting of hydrogen, alkyl, aryl, alkylaryl, acetyl, heteroatoms, and mixtures thereof. Of the suitable aliphatic polyesters, poly(lactide) is preferred. Poly(lactide) is synthesized either from lactic acid by a condensation reaction or more commonly by ring-opening polymerization of cyclic lactide monomer. Since both lactic acid and lactide can be the same repeating unit, the general term poly(lactic acid) as used herein refers to Formula I without any limitation as to how the polymer was made such as from lactides, lactic acid, or oligomers, and without reference to the degree of polymerization or level of plasticization.

The lactide monomer exists generally in three different forms: two stereoisomers L- and D-lactide and racemic D,L-lactide (meso-lactide). The oligomers of lactic acid, and oligomers of lactide are defined by the formula:

Formula II

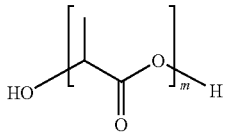

where m is an integer 22≦m≦75. Preferably m is an integer and 2≦m≦10. These limits correspond to number average molecular weights below about 5,400 and below about 720, respectively. The chirality of the lactide units provides a means to adjust, inter alia, degradation rates, as well as physical and mechanical properties. Poly(L-lactide), for instance, is a semicrystalline polymer with a relatively slow hydrolysis rate. This could be desirable in applications of the present invention where a slower degradation of the degradable particulate is desired. Poly(D,L-lactide) may be a more amorphous polymer with a resultant faster hydrolysis rate. This may be suitable for other applications where a more rapid degradation may be appropriate. The stereoisomers of lactic acid may be used individually or combined to be used in accordance with the present invention. Additionally, they may be copolymerized with, for example, glycolide or other monomers like ϵ-caprolactone, 1,5-dioxepan-2-one, trimethylene carbonate, or other suitable monomers to obtain polymers with different properties or degradation times. Additionally, the lactic acid stereoisomers can be modified to be used in the present invention by, inter alia, blending, copolymerizing or otherwise mixing the stereoisomers, blending, copolymerizing or otherwise mixing high and low molecular weight polylactides, or by blending, copolymerizing or otherwise mixing a polylactide with another polyester or polyesters.

Plasticizers may be present in the polymeric degradable materials of the present invention. The plasticizers may be present in an amount sufficient to provide the desired characteristics, for example, (a) more effective compatibilization of the melt blend components, (b) improved processing characteristics during the blending and processing steps, and (c) control and regulation of the sensitivity and degradation of the polymer by moisture. Suitable plasticizers include but are not limited to derivatives of oligomeric lactic acid, selected from the group defined by the formula:

Formula III

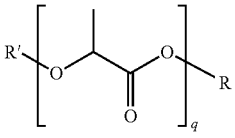

where R is a hydrogen, alkyl, aryl, alkylaryl, acetyl, heteroatom, or a mixture thereof and R is saturated, where R' is a hydrogen, alkyl, aryl, alkylaryl, acetyl, heteroatom, or a mixture thereof and R' is saturated, where R and R' cannot both be hydrogen, where q is an integer and 2≦q≦75; and mixtures thereof. Preferably q is an integer and 2≦q≦10. As used herein the term "derivatives of oligomeric lactic acid" includes derivatives of oligomeric lactide. In addition to the other qualities above, the plasticizers may enhance the degradation rate of the degradable polymeric materials. The plasticizers, if used, are preferably at least intimately incorporated within the degradable polymeric materials.

Aliphatic polyesters useful in the present invention may be prepared by substantially any of the conventionally known manufacturing methods such as those described in U.S. Pat. Nos. 6,323,307; 5,216,050; 4,387,769; 3,912,692; and 2,703,316, the relevant disclosures of which are incorporated herein by reference.

Polyanhydrides are another type of particularly suitable degradable polymer useful in the present invention. Polyanhydride hydrolysis proceeds, inter alia, via free carboxylic acid chain-ends to yield carboxylic acids as final degradation products. The erosion time can be varied over a broad range of changes in the polymer backbone. Examples of suitable polyanhydrides include poly(adipic anhydride), poly(suberic anhydride), poly(sebacic anhydride), and poly(dodecanedioic anhydride). Other suitable examples include but are not limited to poly(maleic anhydride) and poly(benzoic anhydride).

The physical properties of degradable polymers depend on several factors such as the composition of the repeat units, flexibility of the chain, presence of polar groups, molecular mass, degree of branching, crystallinity, orientation, etc. For example, short chain branches reduce the degree of crystallinity of polymers while long chain branches lower the melt viscosity and impart, inter alia, elongational viscosity with tension-stiffening behavior. The properties of the material utilized can be further tailored by blending, and copolymerizing it with another polymer, or by a change in the macromolecular architecture (e.g., hyper-branched polymers, star-shaped, or dendrimers, etc.). The properties of any such suitable degradable polymers (e.g., hydrophobicity, hydrophilicity, rate of degradation, etc.) can be tailored by introducing select functional groups along the polymer chains. For example, poly(phenyllactide) will degrade at about ⅕th of the rate of racemic poly(lactide) at a pH of 7.4 at 55° C. One of ordinary skill in the art with the benefit of this disclosure will be able to determine the appropriate degradable polymer to achieve the desired physical properties of the degradable polymers.

Dehydrated salts may be used in accordance with the present invention as a degradable material. A dehydrated salt is suitable for use in the present invention if it will degrade over time as it hydrates. For example, a particulate solid anhydrous borate material that degrades over time may be suitable. Specific examples of particulate solid anhydrous borate materials that may be used include but are not limited to anhydrous sodium tetraborate (also known as anhydrous borax), and anhydrous boric acid. These anhydrous borate materials are only slightly soluble in water. However, with time and heat in a subterranean environment, the anhydrous borate materials react with the surrounding aqueous fluid and are hydrated. The resulting hydrated borate materials are highly soluble in water as compared to anhydrous borate materials and as a result degrade in the aqueous fluid. In some instances, the total time required for the anhydrous borate materials to degrade in an aqueous fluid is in the range of from about 8 hours to about 72 hours depending upon the temperature of the subterranean zone in which they are placed. Other examples include organic or inorganic salts like sodium acetate trihydrate or anhydrous calcium sulphate.

Blends of certain degradable materials may also be suitable. One example of a suitable blend of materials is a mixture of poly(lactic acid) and sodium borate where the mixing of an acid and base could result in a neutral solution where this is desirable. Another example would include a blend of poly (lactic acid) and boric oxide.

In choosing the appropriate degradable material, one should consider the degradation products that will result. These degradation products should not adversely affect other operations or components. The choice of degradable material also can depend, at least in part, on the conditions of the well, e.g., well bore temperature. For instance, lactides have been found to be suitable for lower temperature wells, including those within the range of 60° F. to 150° F., and polylactides have been found to be suitable for well bore temperatures above this range. Also, poly(lactic acid) may be suitable for higher temperature wells. Some stereoisomers of poly(lactide) or mixtures of such stereoisomers may be suitable for even higher temperature applications. Dehydrated salts may also be suitable for higher temperature wells.

The degradable material can be mixed with inorganic or organic compound to form what is referred to herein as a composite. In preferred alternative embodiments, the inorganic or organic compound in the composite is hydrated. Examples of the hydrated organic or inorganic solid compounds that can be utilized in the self-degradable diverting material include, but are not limited to, hydrates of organic acids or their salts such as sodium acetate trihydrate, L-tartaric acid disodium salt dihydrate, sodium citrate dihydrate, hydrates of inorganic acids or their salts such as sodium tetraborate decahydrate, sodium hydrogen phosphate heptahydrate, sodium phosphate dodecahydrate, amylose, starch-based hydrophilic polymers, and cellulose-based hydrophilic polymers.

Figure 24:
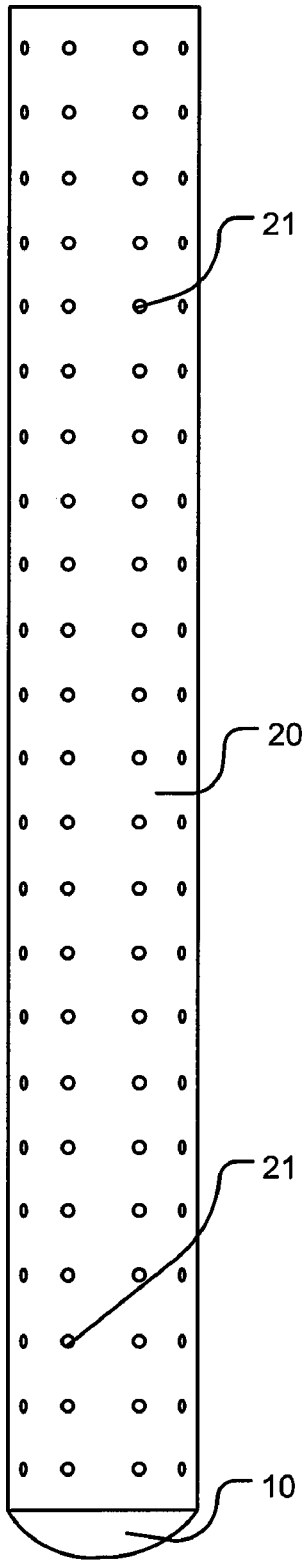
FIG. 24 is a side view of a circulation valve having holes in the side walls.

Referring to FIG. 24, a cross-sectional, side view of a circulation valve of the present invention is illustrated. This circulation valve 20 is a pipe section having holes 21 in its sidewalls and a casing shoe 10 at its bottom. The circulation valve 20 does not comprise a reactive material, but rather comprises steel or other material known to persons of skill.

Figure 25:
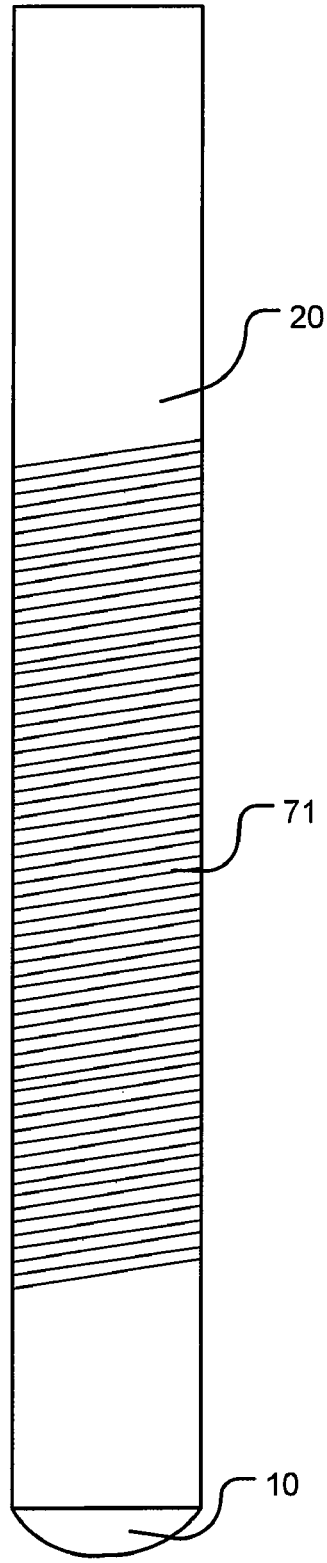
FIG. 25 is a side view of a circulation valve having a wire-wrap screen.

FIG. 25, illustrates a cross-sectional, side view of a circulation valve of the present invention. This circulation valve 20 is a pipe section a wire-wrap screen 71 and a casing shoe 10 at its bottom. The circulation valve 20 does not comprise a reactive material, but rather comprises steel or other material and a wire-wrap screen as is known to persons of skill.

Figure 26A:
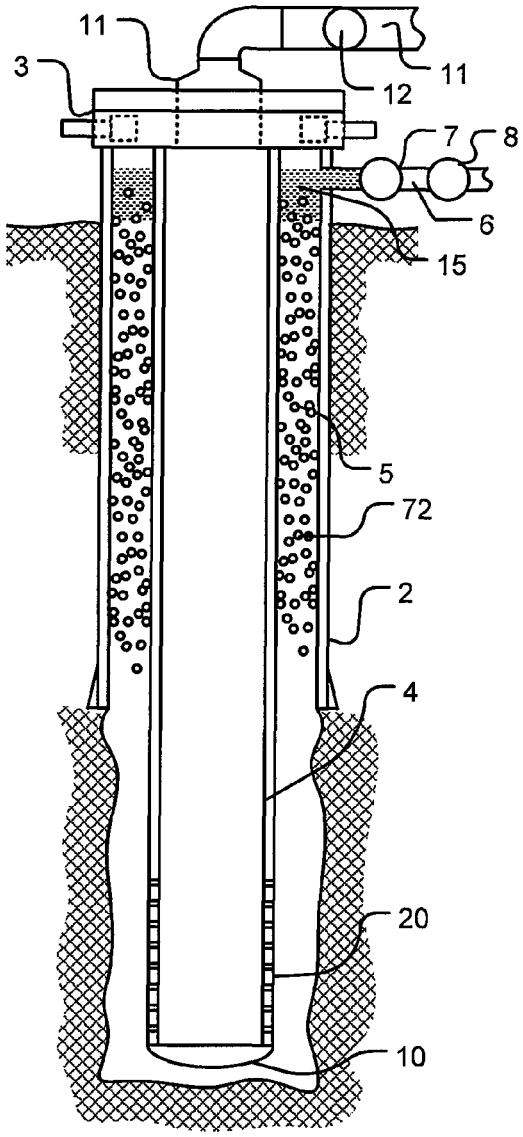
FIG. 26A is a cross-sectional side view of a well bore with casing having a casing shoe and a circulation valve wherein the casing is suspended from a wellhead supported on surface casing, and wherein a particulate material suspended in a slurry is pumped down the annulus ahead of the leading edge of a cement composition.
Figure 26B:
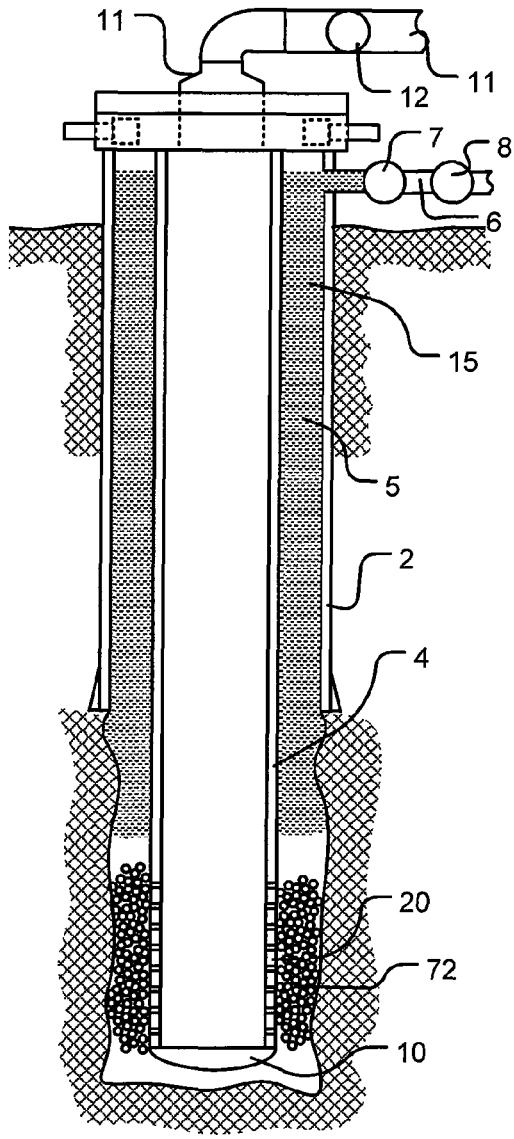
FIG. 26B is a cross-sectional side view of the well bore shown in FIG. 26A, wherein the particulate material is accumulated around the circulation valve in the annulus.

The circulation valves of FIGS. 24 and 25 are used in an inventive method illustrated in FIGS. 26A and 26B, which show cross-sectional, side view of a well bore having casing 4, surface casing 2 and a well head 3. An annulus 5 is defined between the casing 4 and the surface casing 2 at the top and well bore at the bottom. In this embodiment of the invention a particulate material 72 is pumped down the annulus ahead of the leading edge of a cement composition 15. The particulate material 72 is suspended in a slurry so that the particles will flow down the annulus without blockage. The particulate material 72 has a particle size larger than the holes or wire-wrap screen in the circulation valve 21. Thus, as shown in FIG. 26B, when the particulate material 72 reaches the circulation valve, it is unable to flow through the circulation valve so that it is stopped in the annulus. The particulate material 72 forms a log jam in the annulus 5 around the circulation valve 20. The particulate material 72 forms a "gravel pack" of sorts to restrict fluid flow through the circulation valve 20. Because cement compositions are typically more dense than circulation fluids, which may be used to suspend the particulate material 72, some of the circulation fluid may be allowed to pass through the particles while the cement composition is blocked and caused to stand in the annulus 5.

The particulate material 72 may comprise flakes, fibers, superabsorbents, and/or particulates of different dimensions. Commercial materials may be used for the particulate material such as FLOCELE (contains cellophane flakes), PHENOSEAL (available from Halliburton Energy Services), BARACARB (graded calcium carbonate of, for example, 600-2300 microns mean size), BARAPLUG (a series of specially sized and treated salts with a wide distribution of particle sizes), BARARESIN (a petroleum hydrocarbon resin of different particle sizes) all available from Halliburton Energy Services, SUPER_SWEEP (a synthetic fiber) available from Forta Corporation, Grove City, Pa., and any other fiber capable of forming a plugging matt structure upon deposition and combinations of any of the above. Upon deposition around the circulation valve, these particulate materials form a cake, filter-cake, or plug around the circulation valve 20 to restrict and/or stop the flow of fluid through the circulation valve.

Therefore, the present invention is well adapted to carry out the objects and attain the ends and advantages mentioned as well as those that are inherent therein. While numerous changes may be made by those skilled in the art, such changes are encompassed within the spirit of this invention as defined by the appended claims.

What is claimed is:

1. A method of cementing casing in a well bore, the method comprising:

running an annulus packer comprising a reactive material into the well bore on the casing;

reverse-circulating an activator material in the well bore until the activator material contacts the reactive material of the packer;

reconfiguring the packer upon contact of the activator material with the reactive material; and reverse-circulating a cement composition in the well bore until the reconfigured packer decreases flow of the cement composition.

2. The method of claim 1, wherein said reconfiguring the packer comprises expanding the reactive material of the packer by contact with the activator material.

3. The method of claim 1, wherein said reconfiguring the packer comprises shrinking the reactive material of the packer by contact with the activator material.

4. The method of claim 1, wherein said reconfiguring the packer comprises dissolving the reactive material of the packer by contact with the activator material.

5. The method of claim 1 further comprising running an isolation valve into the well bore with the packer; and closing the isolation valve after the packer decreases flow of the cement composition.

6. The method of claim 1, further comprising reverse-circulating a buffer fluid between said reverse-circulating the activator material and said reverse-circulating cement composition.

7. A method of cementing casing in a well bore, the method comprising:

running an annulus packer comprising a reactive material and a protective material into the well bore on the casing;

reverse-circulating an activator material in the well bore until the activator material contacts the protective material of the packer, wherein the activator material erodes the protective material to expose the reactive material;

reconfiguring the packer by contact of the reactive material with a well bore fluid; and reverse-circulating a cement composition in the well bore until the reconfigured packer decreases flow of the cement composition.

8. The method of claim 7, wherein the exposing the reactive material to a well bore fluid comprises exposing the reactive material to a well bore fluid selected from the group of fluids consisting of water, drilling mud, circulation fluid, fracturing fluid, cement composition, fluid leached into the well bore from a formation, and activator material.

9. The method of claim 7, wherein said reconfiguring the packer comprises expanding the reactive material of the packer by contact with a well bore fluid.

10. The method of claim 7, wherein said reconfiguring the packer comprises shrinking the reactive material of the packer by contact with a well bore fluid.

11. The method of claim 7, wherein said reconfiguring the packer comprises dissolving the reactive material of the packer by contact with a well bore fluid.

12. The method of claim 7, further comprising running an isolation valve into the well bore with the packer; and closing the isolation valve after the packer decreases flow of the cement composition.

13. The method of claim 7, further comprising reverse-circulating a buffer fluid between said reverse-circulating the activator material and said reverse-circulating cement composition.

14. A packer for cementing casing in a well bore wherein an annulus is defined between the casing and the well bore, the packer comprising:

a packer element connected to the casing, wherein the packer element allows fluid to pass through the a well bore annulus past the packer element when it is in a non-expanded configuration, and wherein the packer element restricts fluid passage in the annulus past the packer element when the packer element is expanded;

an expansion device in communication with the packer element; and a lock that prevents the expansion device from expanding the packer element, wherein the lock comprises a reactive material.

15. The packer of claim 14, wherein the reactive material of said lock comprises an expandable material that expands by contact with an activator material, wherein the lock becomes unlocked upon expansion of the expandable material.

16. The packer of claim 14, wherein the reactive material of said lock comprises a shrinkable material that shrinks by contact with an activator material, wherein the lock becomes unlocked upon shrinkage of the shrinkable material.

17. The packer of claim 14, wherein the reactive material of said lock comprises a dissolvable material that dissolves by contact with an activator material, wherein the lock becomes unlocked upon dissolution of the dissolvable material.

18. The packer of claim 14, further comprising a protective material that coats the reactive material, wherein the protective material is readable by an activator material to expose the reactive material to a well bore fluid, whereby the lock becomes unlocked upon exposure of the reactive material to the well bore fluid.

19. The packer as claimed in claim 18, wherein the reactive material unlocks the lock upon contact with a well bore fluid selected from the group of fluids consisting of water, drilling mud, circulation fluid, fracturing fluid, cement composition, fluid leached into the well bore from a formation, and activator material.

20. The packer of claim 18, wherein the reactive material of said lock comprises an expandable material that expands by contact with a well bore fluid, wherein the lock becomes unlocked upon expansion of the expandable material.

21. The packer of claim 18, wherein the reactive material of said lock comprises a shrinkable material that shrinks by contact with a well bore fluid, wherein the lock becomes unlocked upon shrinkage of the shrinkable material.

22. The packer of claim 18, wherein the reactive material of said lock comprises a dissolvable material that dissolves by contact with a well bore fluid, wherein the lock becomes unlocked upon dissolution of the dissolvable material.

23. The packer of claim 14, further comprising an isolation valve.

* * * * *